US006159083A

United States Patent [19]

Appel et al.

[11] Patent Number: 6,159,083

[45] Date of Patent: Dec. 12, 2000

[54] POLISHING HEAD FOR A CHEMICAL MECHANICAL POLISHING APPARATUS

[75] Inventors: Gregory A. Appel, San Francisco; Charles J. Regan, Moraga; David E. Weldon, Santa Clara; Shou-sung Chang; Gregory C. Lee, both of Sunnyvale, all of Calif.

[73] Assignee: Aplex, Inc., Sunnyvale, Calif.

[21] Appl. No.: 09/116,160

[22] Filed: Jul. 15, 1998

[51] Int. Cl.[7] ..... B24B 7/22

[52] U.S. Cl. ..... 451/289

[58] Field of Search ..... 451/41, 285, 287, 451/288, 289, 388, 398

[56] References Cited

U.S. PATENT DOCUMENTS

| | | | |
|---|---|---|---|
| 4,811,522 | 3/1989 | Gill, Jr. | 451/288 |
| 4,918,869 | 4/1990 | Kitta | 451/288 |
| 4,944,119 | 7/1990 | Gill, Jr. et al. | 451/331 |
| 5,081,795 | 1/1992 | Tanaka et al. | 451/288 |
| 5,095,661 | 3/1992 | Gill, Jr. et al. | 451/111 |
| 5,205,082 | 4/1993 | Shendon et al. | 451/41 |
| 5,230,184 | 7/1993 | Bukhman | 451/41 |
| 5,441,444 | 8/1995 | Nakajima | 451/289 |
| 5,527,209 | 6/1996 | Volodarsky et al. | 451/388 |
| 5,624,299 | 4/1997 | Shendon | 451/28 |
| 5,643,053 | 7/1997 | Shendon | 451/28 |
| 5,643,061 | 7/1997 | Jackson et al. | 451/289 |
| 5,681,212 | 10/1997 | Hayakawa et al. | 451/288 |
| 5,681,215 | 10/1997 | Sherwood et al. | 451/388 |
| 5,716,258 | 2/1998 | Metcalf | 451/41 |
| 5,961,372 | 10/1999 | Shendon | 451/41 |

*Primary Examiner*—Joseph J. Hail, III
*Assistant Examiner*—Dermott J. Cooke
*Attorney, Agent, or Firm*—Skjerven Morrill MacPherson LLP; David T. Millers

[57] ABSTRACT

A polishing head for a chemical mechanical polishing (CMP) apparatus. The polishing head includes a backplate, a retaining ring supported by the backplate, and a bladder member encircled by the retaining ring. The backplate of the polishing head comprises a driving plate biasedly coupled to a subcarrier by a bellows. The polishing head may further include a lift plate disposed on the subcarrier and beneath the bladder member. A method for polishing a substrate includes placing a substrate on the bladder member and positioning the substrate against a polishing pad such that the bladder member applies a selected pressure profile on the substrate.

31 Claims, 24 Drawing Sheets

POLISHING HEAD FOR A CHEMICAL MECHANICAL POLISHING APPARATUS

BACKGROUND OF THE INVENTION

1. Field of the Invention

This invention relates to chemical mechanical polishing. More specifically, the present invention provides a polishing head for a chemical mechanical polishing apparatus. Moreover, the present invention provides a method for polishing a substrate by employing the polishing head of the present invention.

2. Description of the Prior Art

Sub-micron integrated circuit devices are formed on substrates such as semiconductor wafers by patterning conductive or interconnect film layers (e.g., aluminum (Al), titanium nitride (TiN), etc.) which have been deposited on nonconductive or intermediate dielectric film layers (e.g., silicon oxide ($SiO_x$)). In order to pattern or etch the interconnect film layer, the exposed surface of the interconnect film layer must be topographically planar. An intermediate dielectric film layer having a non-planar surface will transfer its topographical profile to that of the deposited interconnect film layer. As a result, prior to the deposition of the interconnect film layer, the surface of the intermediate dielectric layer has to be planarized. To pose the problem more concretely, the patterning and etching step is prepared by selectively developing photoresist layers on the exposed surface of the interconnect film layer. A non-planar surface prevents the focusing of a photolithography apparatus on the entire exposed surface of the interconnect film layer for the exposure of the photoresists. As a result, the interconnect film layer having a surface defined by a non-planar topography cannot be etched or patterned by photolithographic techniques. The syllogism follows that the intermediate dielectric film layer, on which the interconnect film layer is deposited, must have a planarized surface.

Chemical mechanical polishing (CMP) is one recognized method of planarization. CMP technique requires that the substrate be mounted on a polishing head with the surface of the substrate to be polished exposed. The polishing head, supporting the substrate, is then placed against a linear polishing belt or a planar polishing pad. Referring to FIGS. 32A and 32B, which are schematic side elevational and front elevational views of a linear CMP apparatus, generally illustrated as 300, there is seen a continuous, vertical polishing belt 302 configured to polish a vertically held substrate, such as a semiconductor wafer 82. A polishing head 10 positions the substrate 82 against a polishing pad (omitted from the Figures), which is attached to the vertical polishing belt 302. The polishing belt 302 is kept in continuous motion, as indicated by arrow 308, by rotating pulleys 310 and 312 at a selected polishing speed (e.g., 1–1000 ft/min). A support head 314 provides a base for the application of pressure (e.g., 1–10 psi) by the polishing head 10 against the substrate 82. The polishing head 10 may rotate in a clockwise or counter-clockwise direction, as indicated by arrow 316, and may oscillate or translate back and forth, as indicated by arrow 320, by an oscillating arm 318 of a driving mechanism (omitted from the Figures). Moreover, a slurry, typically a mixture of an abrasive and at least one chemically reactive agent, is supplied to the polishing pad. Accordingly, a chemical reaction and a mechanical abrasion is provided at an interface between the substrate 82 and the polishing pad.

A planar CMP apparatus 400, as illustrated in FIGS. 33A and 33D includes the polishing head 10, horizontally supporting the substrate 82. The polishing head 10, as mentioned above, rotates in a clockwise or counterclockwise direction, as indicated by the arrow 316, and is oscillated back and forth, as indicated by the arrow 320, by the oscillating arm 318 of the driving mechanism (omitted from the Figures). However, in lieu of the continuous, vertical polishing belt 302, a rotating, planar polishing platen 402 is provided. The planar polishing platen 402 supports and rotates a polishing pad 404 about a driving shaft 406. The rotation of the polishing platen 402 is indicated by arrow 408. A slurry is provided to the polishing pad 404 for providing the abrasive chemical solution.

A recurring problem with the CMP process is the inconsistency in the removal rates across the surface of a substrate. CMP has a tendency to differentially polish, i.e., over-polish or under-polish, particular localized regions of the substrate surface. For example, an outer circumferential region, typically 5–20 mm in length, is an area where over-polishing at times occurs. As a result, the substrate procures a non-planar, convex shaped surface, impeding any further use of photolithography for patterning purposes. Therefore, the CMP apparatus should have a polishing head which increases surface planarity and polishing uniformity.

SUMMARY OF THE INVENTION

The present invention broadly provides a polishing head for a chemical mechanical polishing apparatus, comprising:

a) a bladder means for receiving a substrate and applying pressure to the substrate;

b) a retaining means encircling the bladder means for containing a substrate on the bladder means; and c) backplate means supporting the retaining means.

The present invention, more specifically, provides a polishing head that includes a retaining ring which is supported by a backplate. The retaining ring encircles a bladder member such that a substrate can be positioned and contained on the bladder member. The backplate comprises a driving plate biasedly coupled to a subcarrier. A bellows biasedly couples the driving plate to the subcarrier. The polishing head may further include a lift plate disposed beneath the bladder member and biasedly engaged to the subcarrier by an actuator and a spring pin assembly. The lift plate is capable of compressing the bladder in an outwardly direction. The bladder member is also capable of expanding in an outwardly direction for applying pressure to a substrate against a polishing pad. Moreover, the bladder member is capable of withdrawing in an inwardly direction to releasably grasp a substrate.

The bladder member is generally defined by a base and a side-wall extending from the base. In one implementation, the side-wall includes an indented portion for allowing the side-wall to complyingly support the base. In another implementation, a rolling wall is integrally extending from the side-wall for allowing the side-wall to complyingly support the base.

The invention also broadly provides a method for polishing a substrate, comprising:

a) providing a polishing head having a bladder member;

b) positioning a substrate on the bladder member;

c) withdrawing the bladder member in an inwardly direction to create a vacuum between the bladder member and the substrate;

d) positioning the substrate on a polishing pad; and e) polishing the substrate.

The polishing head of the above method encompasses the aforementioned embodiment, i.e., the retaining ring engaged to the subcarrier, the driving plate biasedly coupled to the subcarrier, and the lift plate positioned beneath the bladder member. To operate the polishing head using a chemical mechanical polishing device, the polishing head is initially located at a "load position" where the lift plate is actuated in an outwardly direction. The bladder member is compressed in an outwardly direction by the lift plate and a substrate is positioned on the bladder member. Next, the bladder member is withdrawn in an inwardly direction to create a vacuum between the bladder member and the substrate. The lift plate is actuated in an inwardly direction while maintaining the vacuum between the bladder member and the substrate. As a result, the bladder member removably grasps the substrate. The polishing head is positioned proximal a polishing pad such that an outwardly actuation of the subcarrier abuts the retaining ring against the polishing pad. After the retaining ring is compressed against the polishing pad, the bladder member 70 is expanded in an outwardly direction to apply pressure to the substrate.

After the completion of the polishing process, the lift plate is actuated in the outwardly direction so as to assist in withdrawing the bladder member in the inwardly direction. The bladder member is withdrawn in the inwardly direction so as to removably grasp the substrate. Next, the lift plate is actuated in the inwardly direction while maintaining the grasp between the bladder member and the substrate. The retaining ring is disengaged from the polishing pad by actuating the subcarrier in an inwardly direction. The polishing head is placed at the "load position," the lift plate compresses the bladder member in the outwardly direction, and the polished substrate is removed.

These features together with various ancillary advantages which will become apparent to those skilled in the art as the following description proceeds, are attained by these novel polishing head devices and methods of using the same, the preferred embodiments thereof shown with reference to the accompanying drawings, by way of example only, wherein:

DESCRIPTION OF THE PREFERRED EMBODIMENTS

Figure 1:
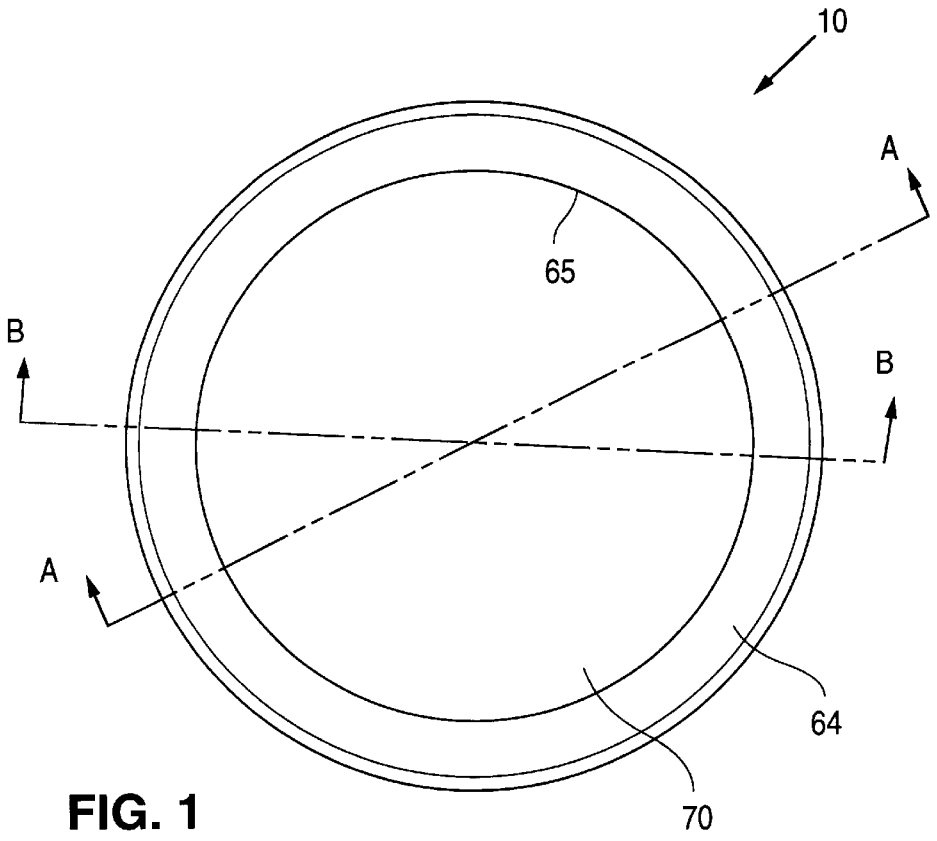
FIG. 1 is a top plan view of the polishing head of the present invention, illustrating a retaining ring and a bladder member.
Figure 2:
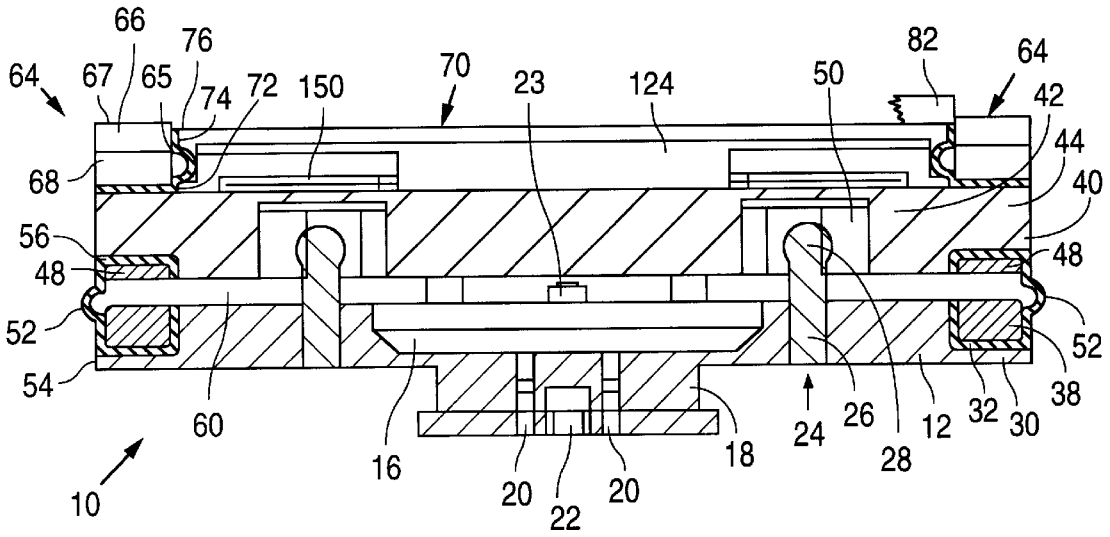
FIG. 2 is a side cross sectional view of one embodiment of the polishing head taken in the direction of the arrows and along the plane of line A—A of FIG. 1, illustrating a driving plate biasedly coupled to a subcarrier with a bellows, the retaining ring supported by the subcarrier, the bladder member encircled by the retaining ring, and a lift plate biasedly coupled to the subcarrier; in this embodiment, the bladder member is defined by a base and a side-wall extending from the base wherein the side-wall comprises an indented portion protruding therefrom for allowing the side-wall to complyingly support the base.
Figure 3:
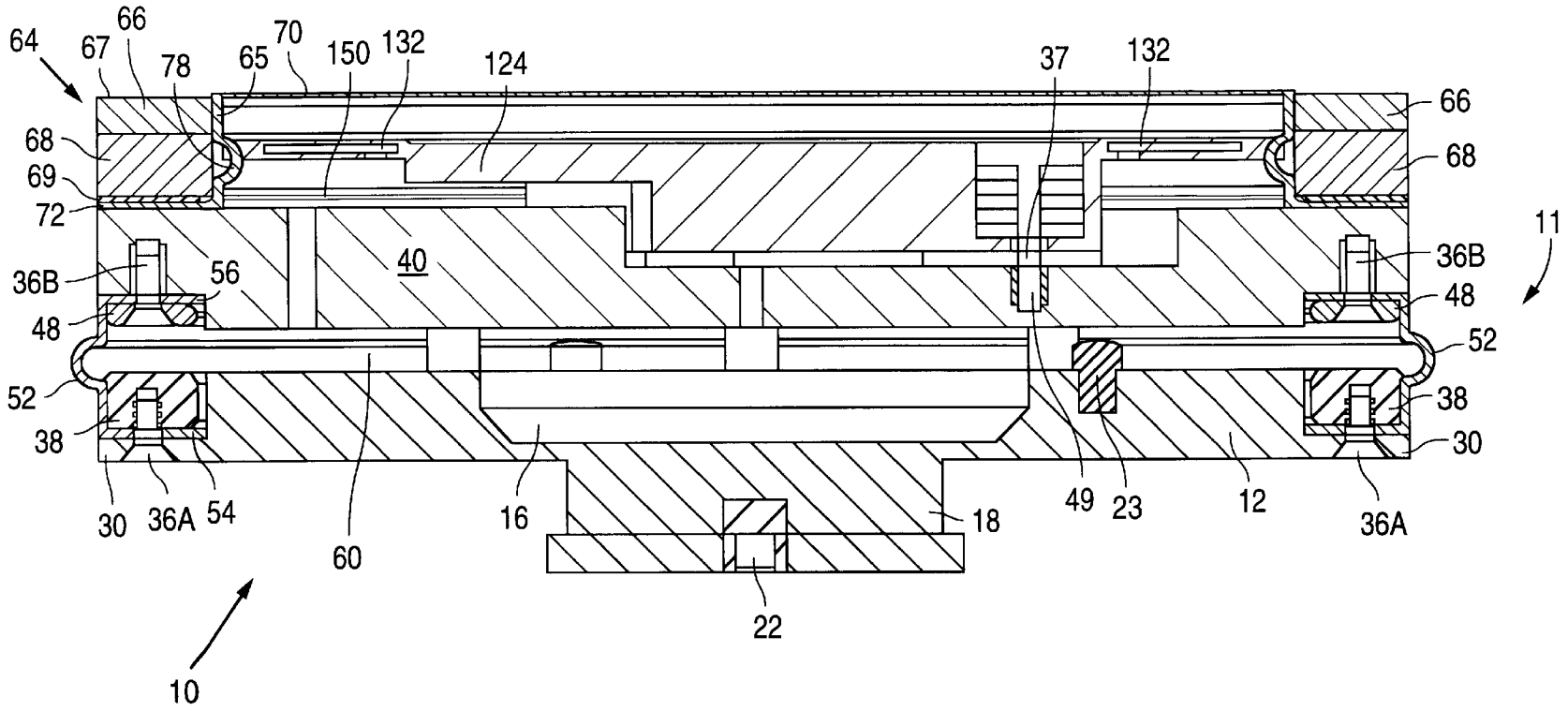
FIG. 3 is a side cross sectional view of the polishing head of FIG. 2 taken in the direction of the arrows and along the plane of line B—B of FIG. 1, illustrating the driving plate biasedly coupled to the subcarrier with the bellows, the retaining ring supported by the subcarrier, the bladder member encircled by the retaining ring, and the lift plate biasedly coupled to the subcarrier by an actuator and a spring pin assembly.
Figure 4:
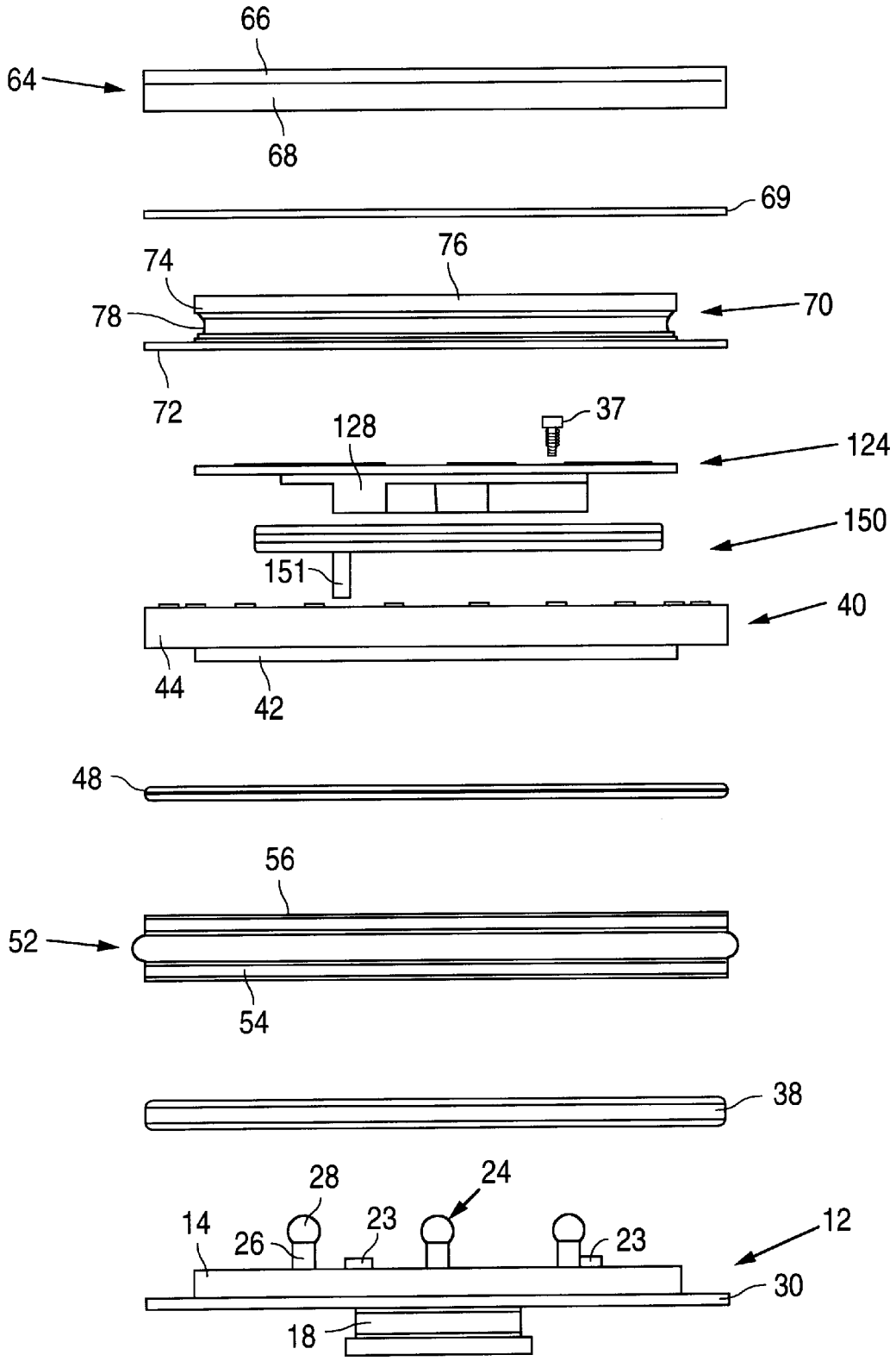
FIG. 4 is an exploded side elevational view of the polishing head of FIGS. 2 and 3, illustrating in detail, from top to bottom, the retaining ring, a shim, the bladder member, the spring pin assembly, the lift plate, the actuator, the subcarrier, a second clamp, the bellows, a first clamp, and the driving plate.
Figure 5:
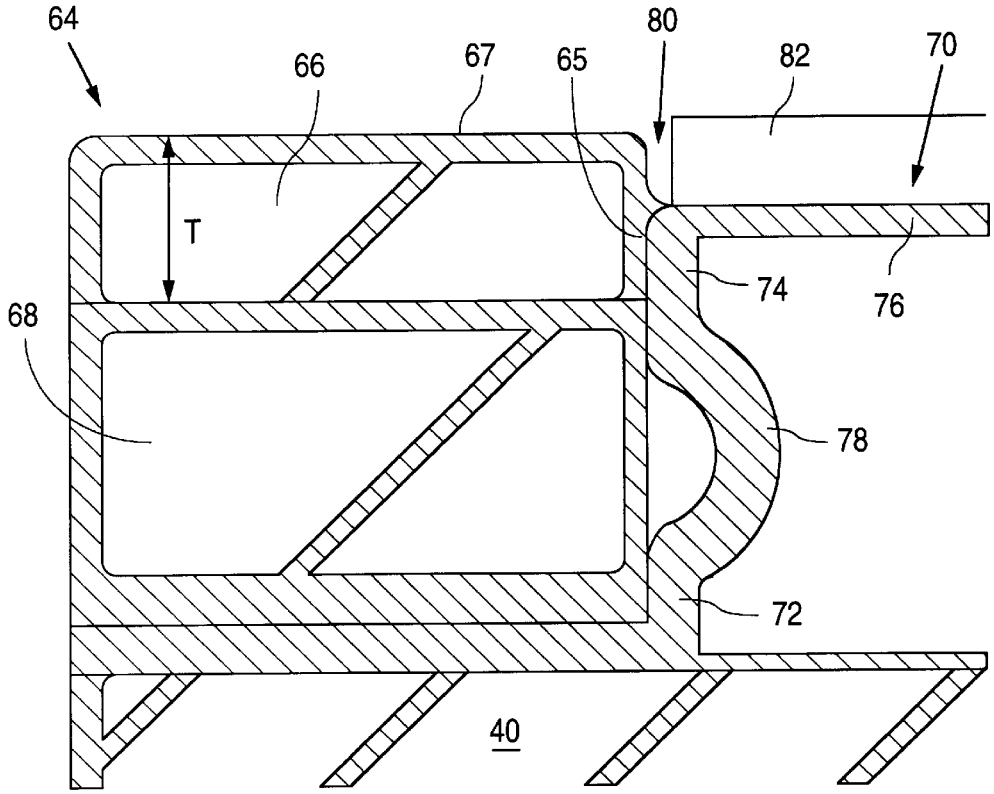
FIG. 5 is a partial, enlarged, side cross sectional view of the polishing head of FIGS. 2–4, clearly illustrating the bladder member being generally defined by the base, the side-wall extending from the base and having an indented portion formed therein for allowing the side-wall to complyingly support the base, and a rim portion extending from the side-wall and engaged between the retaining ring and the subcarrier.
Figure 6:
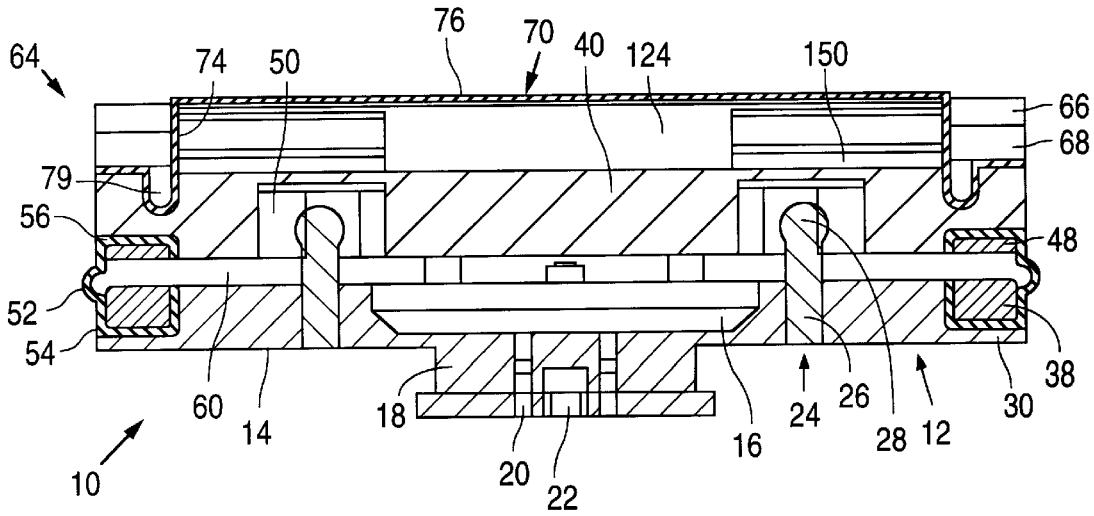
FIG. 6 is a side cross sectional view of another embodiment of the polishing head taken in the direction of the arrows and along the plane of line A—A of FIG. 1, illustrating the driving plate biasedly coupled to the subcarrier with a bellows, the retaining ring supported by the subcarrier, the bladder member encircled by the retaining ring, and the lift plate biasedly coupled to the subcarrier; in this embodiment, the bladder member is defined by the base and the side-wall extending from the base wherein the side-wall comprises a rolling wall extending therefrom and disposed in an annular groove of the subcarrier for allowing the side-wall to complyingly support the base.
Figure 7:
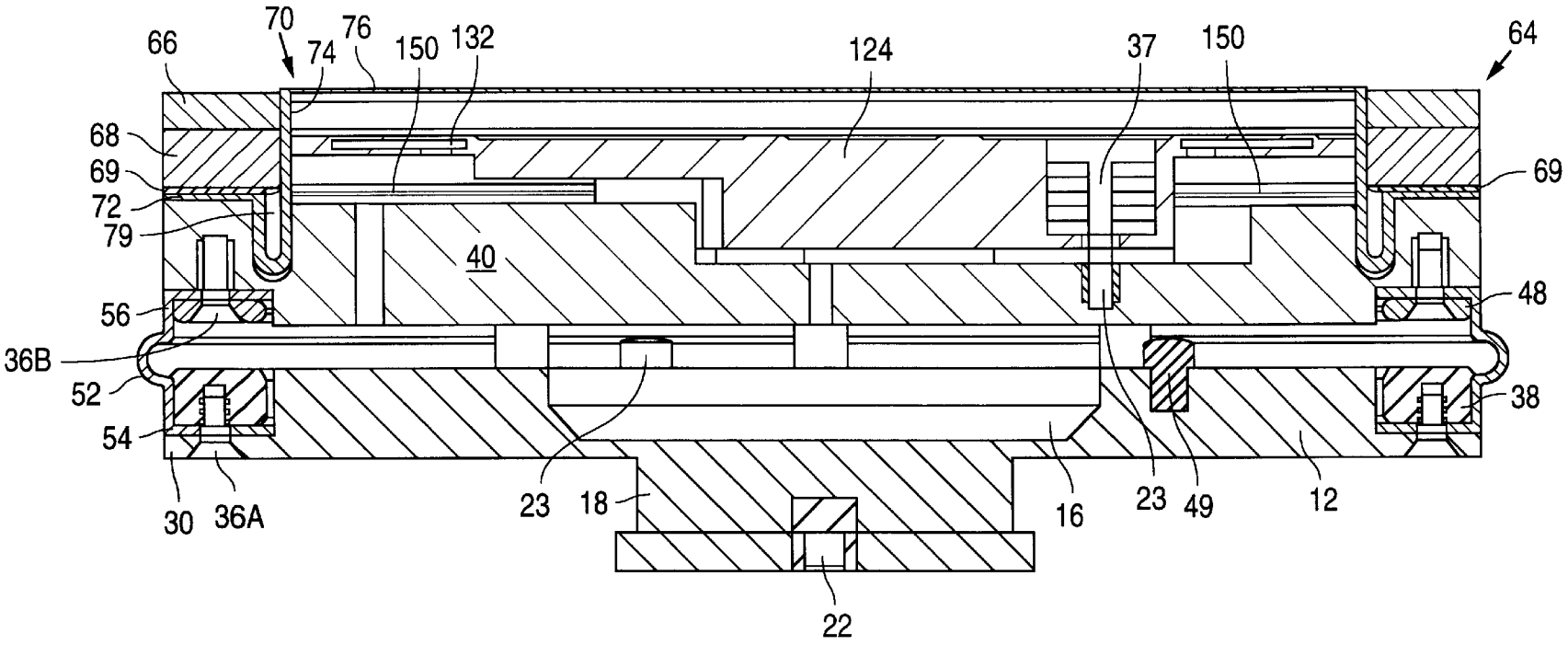
FIG. 7 is a side cross sectional view of the polishing head of FIG. 6 taken in the direction of the arrows and along the plane of line B—B of FIG. 1, illustrating the driving plate biasedly coupled to the subcarrier with the bellows, the retaining ring supported by the subcarrier, the bladder member encircled by the retaining ring, and the lift plate biasedly coupled to the subcarrier by an actuator and a spring pin assembly.
Figure 8:
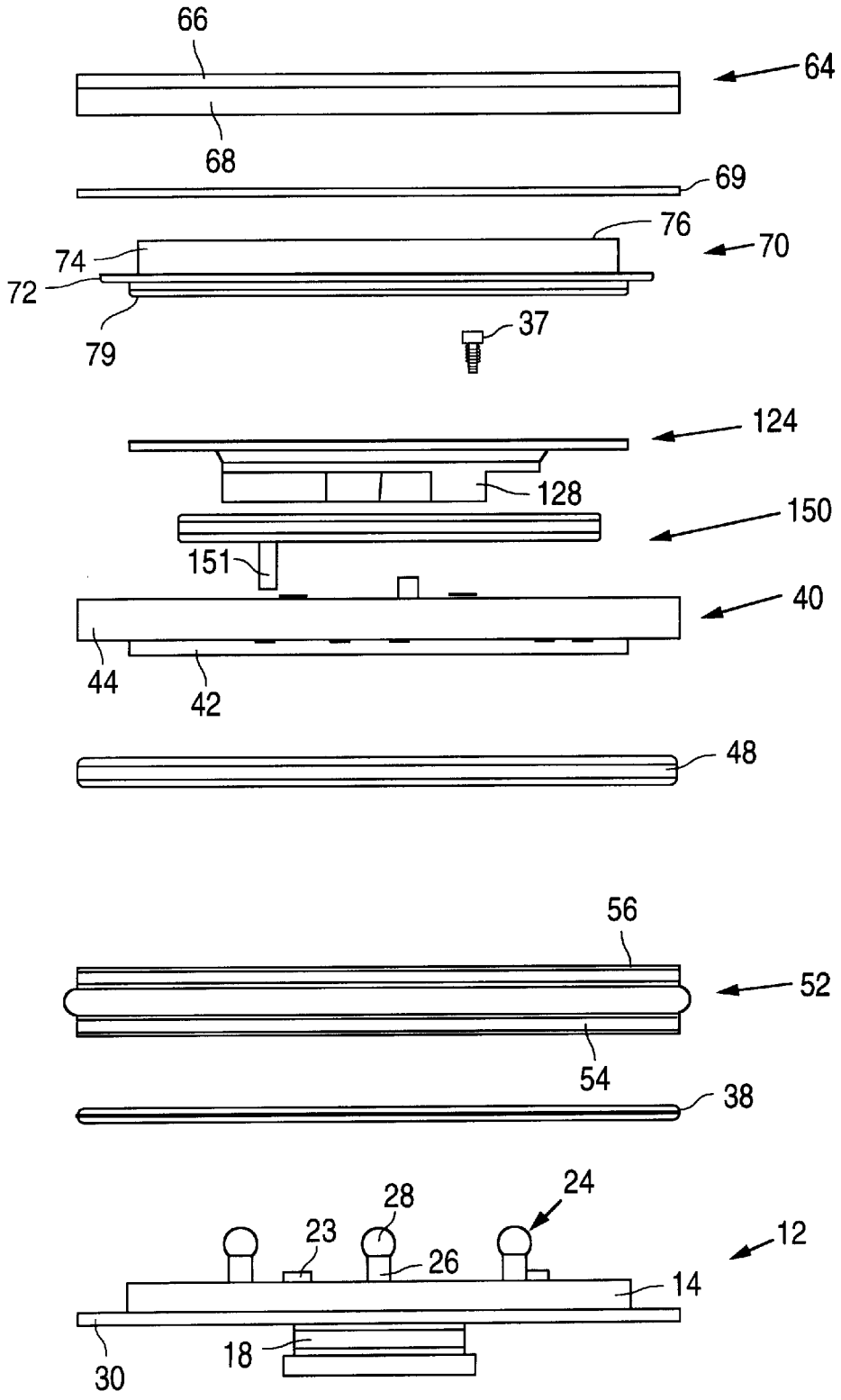
FIG. 8 is an exploded side elevational view of the polishing head of FIGS. 6 and 7, illustrating in detail, from top to bottom, the retaining ring, the shim, the bladder member, the spring pin assembly, the lift plate, the actuator, the subcarrier, the second clamp, the bellows, the first clamp, and the driving plate.
Figure 9:
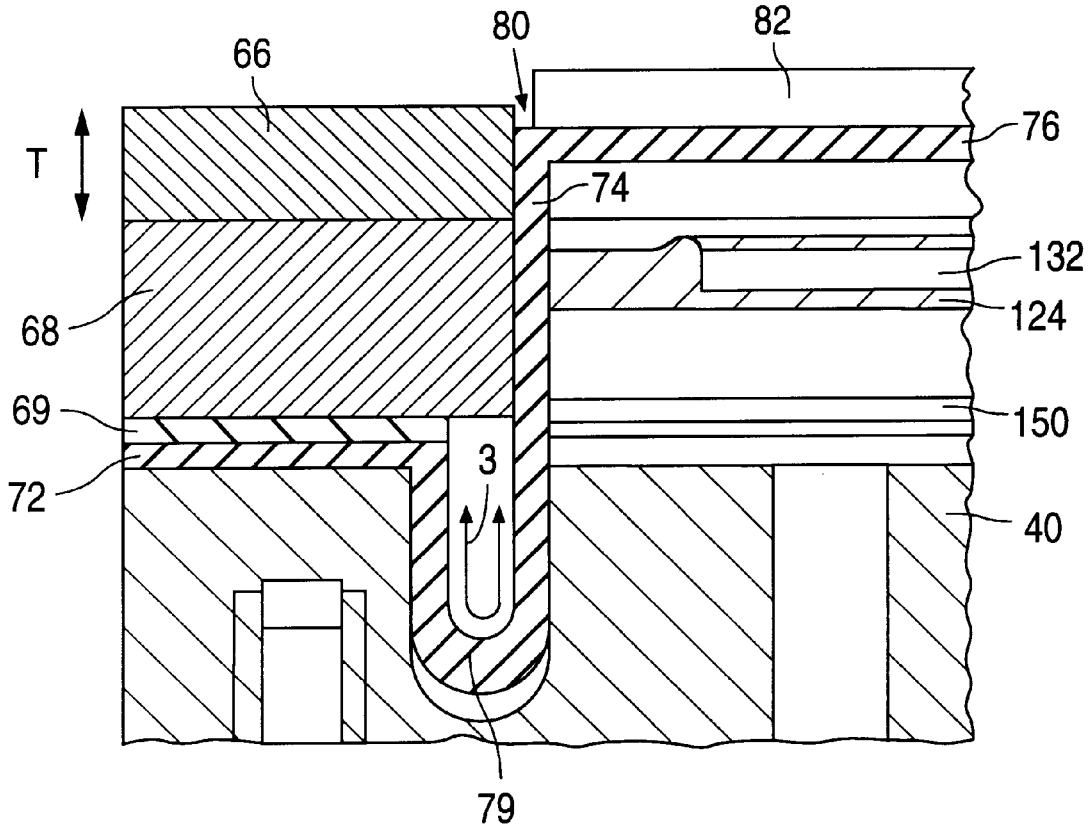
FIG. 9 is a partial, enlarged, side cross sectional view of the polishing head of FIGS. 6–8, clearly illustrating the bladder member being generally defined by the base, the side-wall extending from the base, the rolling wall integrally extending from the side-wall and disposed in the annular groove of the subcarrier for allowing the side-wall to complyingly support the base, and the rim portion extending from the rolling wall and engaged between the retaining ring and the subcarrier.
Figure 10:
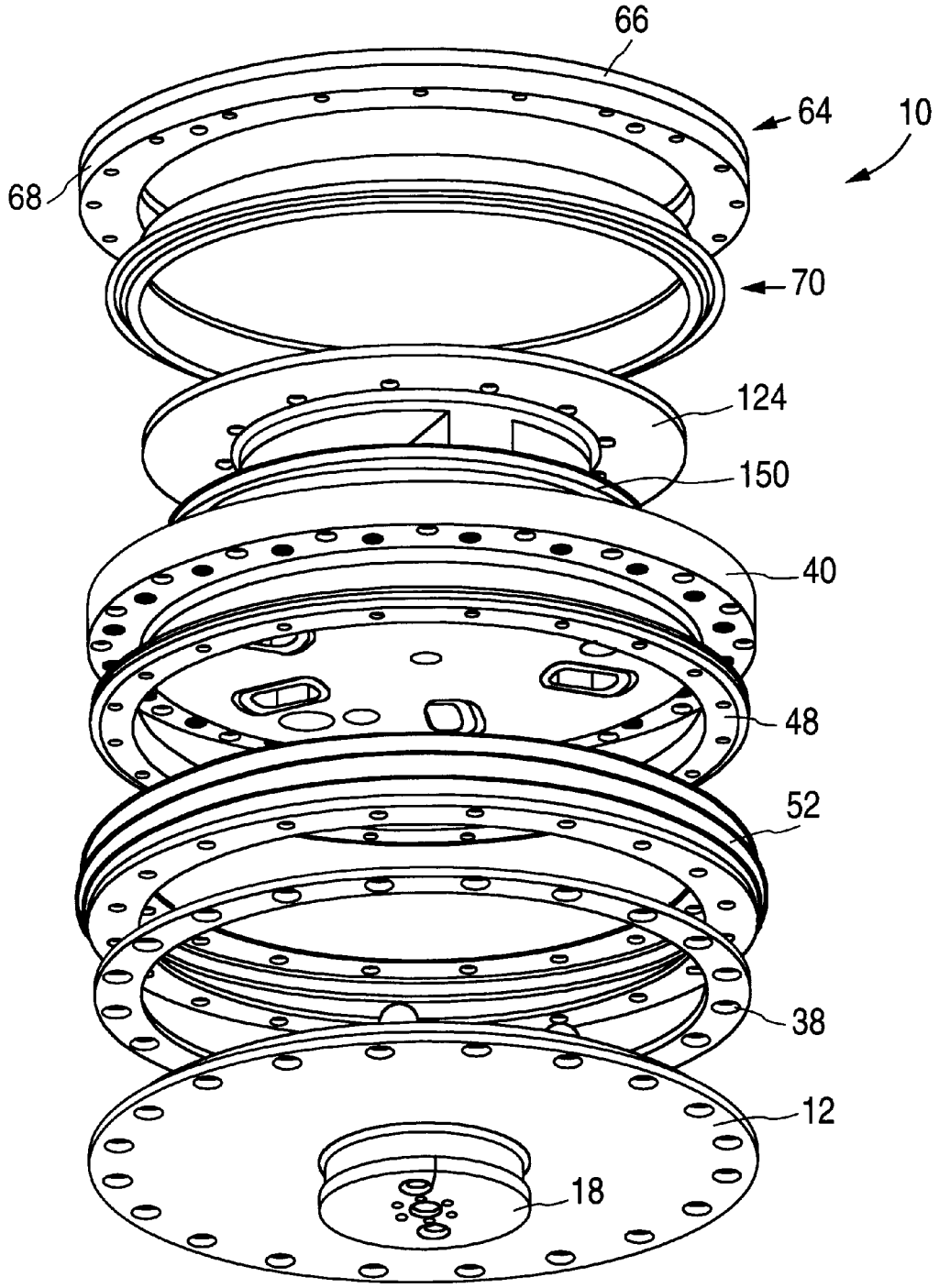
FIG. 10 is a bottom perspective view of the disassembled polishing head of FIG. 1.
Figure 11:
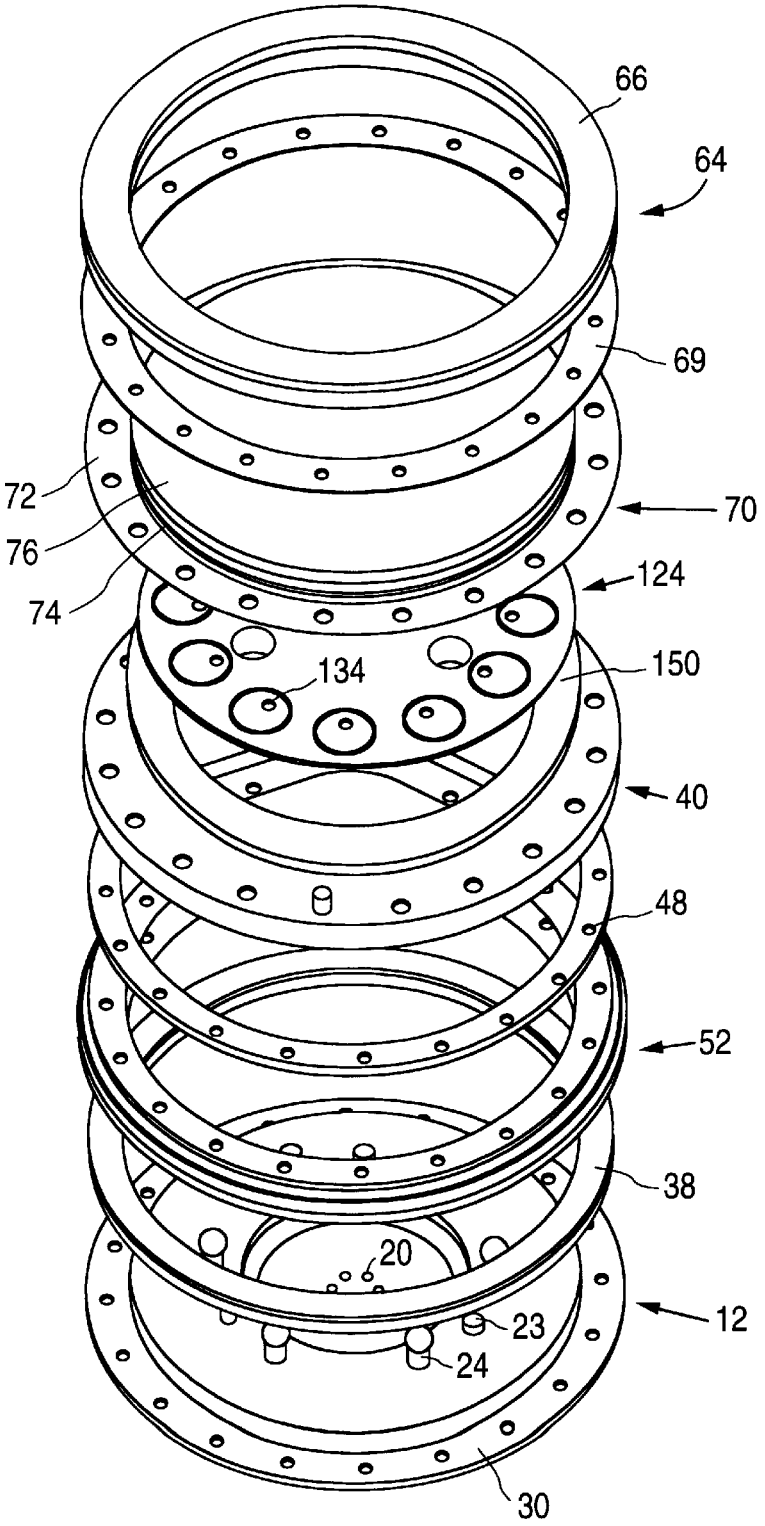
FIG. 11 is a top perspective view of the disassembled polishing head of FIG. 1.
Figure 12:
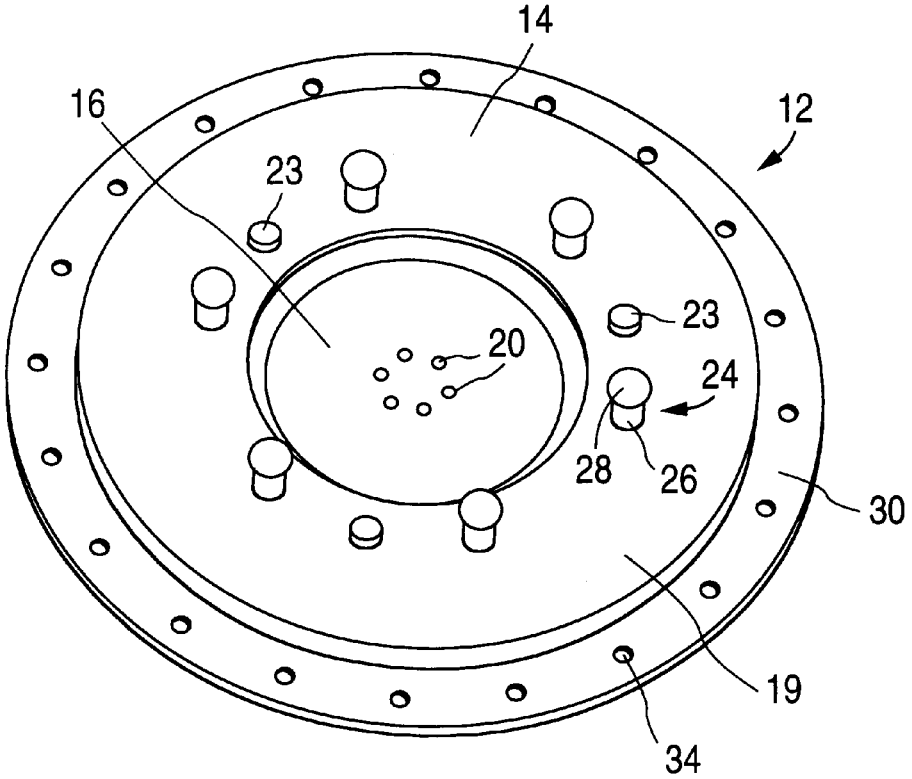
FIG. 12 is a top perspective view of the driving plate for the polishing head of the present invention, illustrating a structure defining a disc member, an inner annular void formed the disc member, a cap member surrounding the inner annular void and disposed on a back side of the disc member, a first lip defining an outer annular region of the disc member, tooling balls and knobs engaged to a front side of the disc member, and inlet holes formed in the cap member.
Figure 13:
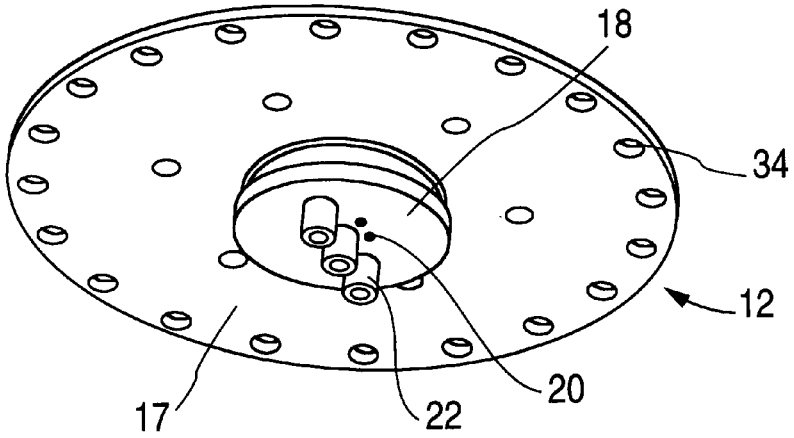
FIG. 13 is a bottom perspective view of the driving plate for the polishing head of the present invention, clearly illustrating the cap member having the inlet holes and a plurality of alignment holes.
Figure 14:
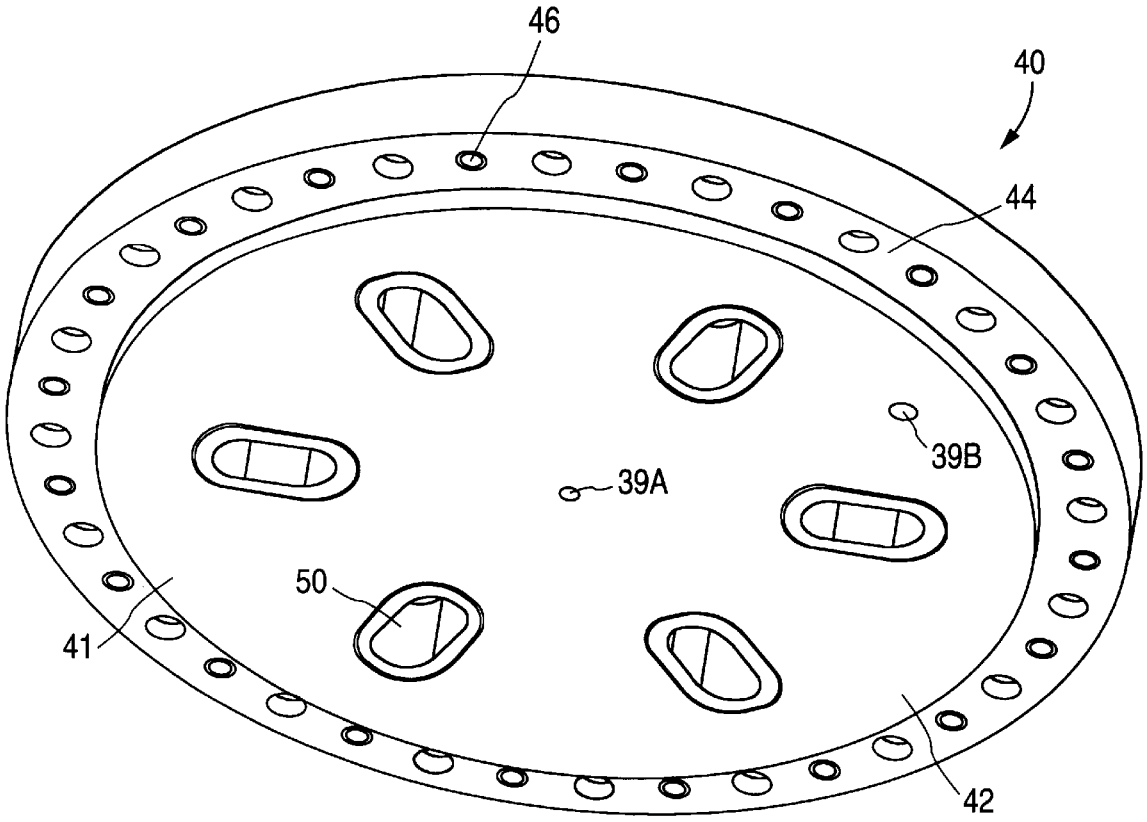
FIG. 14 is a bottom perspective view of the subcarrier for the polishing head of the present invention, illustrating a back side having a disc body protruding therefrom such that a second lip is formed on the subcarrier and a plurality of receiving slots disposed in the disc body for receiving the tooling balls.
Figure 15:
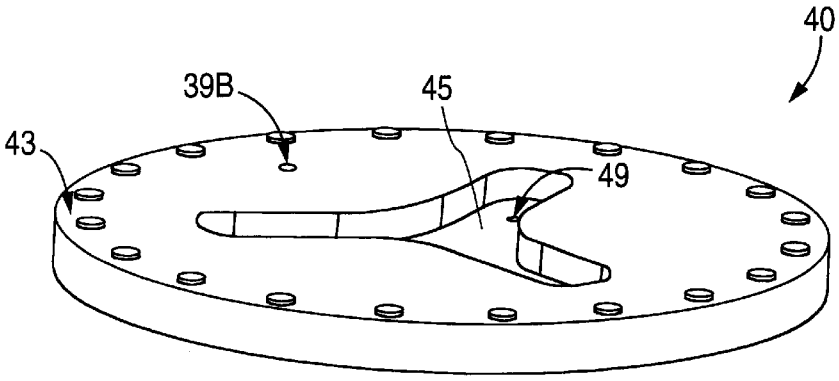
FIG. 15 is a top perspective view of the subcarrier used in conjunction with the first embodiment of the polishing head of FIGS. 2–5, illustrating a front side having a cavity region.
Figure 16:
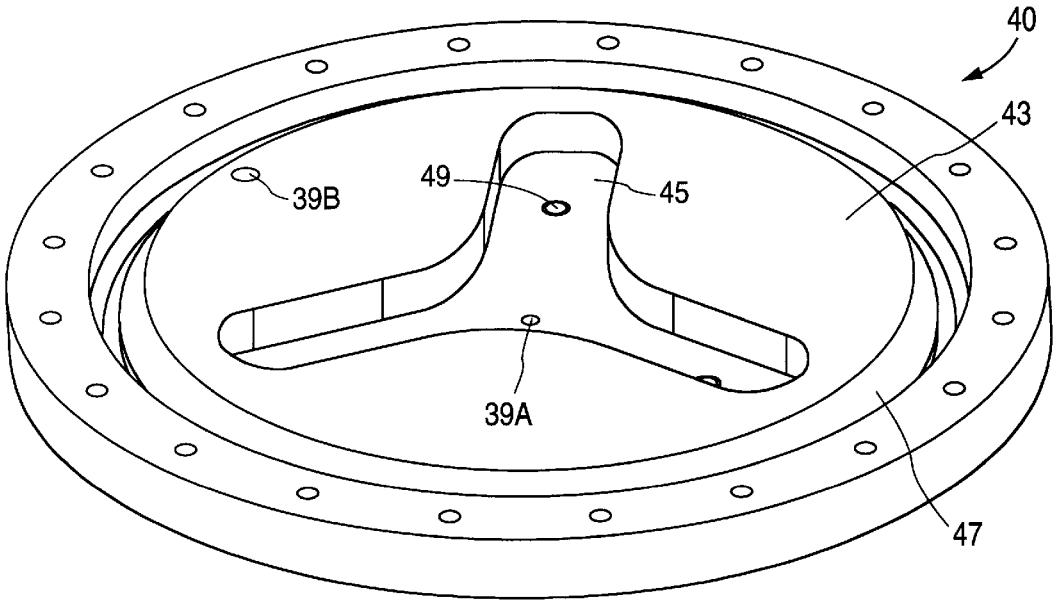
FIG. 16 is a top perspective view of the subcarrier used in conjunction with the second embodiment of the polishing head of FIGS. 6–9, illustrating the front side having the cavity region and the annular groove for receiving the rolling wall of the bladder member.

Referring in detail now to the drawings wherein similar parts on the present invention are represented by like reference numerals, there is seen in FIGS. 1–31 a polishing head, generally illustrated as 10, in accordance with the present invention. The polishing head 10 may be used with any polishing apparatus such as a linear 300 or planar 400 chemical mechanical polishing devices (see FIGS. 32A–B and 33A–B for schematic illustrations of the linear 300 and the planar 400 polishing devices). The polishing head 10 comprises a backplate 11 which includes a driving plate 12 biasedly coupled to a subcarrier 40 (see FIG. 2). The driving plate 12 comprises a structure generally defining a disc member 14 having an inner annular void 16 (see FIGS. 12 and 13). A cap member 18 surrounds the inner annular void 16 and is disposed on a back side 17 of the disc member 14. A plurality of inlet holes 20 and alignment holes 22 are disposed in the cap member 18. The cap member 18 is coupled to a driving mechanism, for example an oscillating arm 318 as illustrated in FIGS. 32A, 32B, 33A and 33B. The alignment holes 22 are used to align the polishing head 10 to the driving mechanism. The inlet holes 20 are used as a means to supply pressure/vacuum pressure to the polishing head 10, as will be described below. Further structure of the driving plate 12 includes tooling balls 24 engaged on a front side 19 of the disc member 14. The tooling balls 24 have a structure generally defined by a pole section 26 terminating in a ball section 28. The tooling balls 24 are used as a means of applying a torque to the subcarrier 40. Knobs 23, configured to limit an inwardly actuation of the subcarrier 40, are also engaged to the front side 19 of the disc member 14, as will be described later in the application. A first lip 30 extends from the disc member 14 of the driving plate 12. The first lip 30 comprises plate recesses 34 for receiving screws 36A to capture a first clamp member 38 (see FIG. 3). The driving plate 12 of the present invention may be manufactured from any suitable material, including stainless steel, aluminum, etc.

Continuing to refer to FIGS. 1–31, the backplate 11, as mentioned above, further includes the subcarrier 40. The subcarrier 40 includes a backside 41 having a disc body 42 protruding therefrom such that a second lip 44 is formed on the subcarrier 40 (see FIG. 14). The second lip 44 includes carrier recesses 46 for receiving screws 36B to capture a second clamp member 48 (see FIG. 3). Receiving slots 50 are disposed on the disc body 42 for receiving the tooling balls 24. The subcarrier 40 further includes a front side 43 having a cavity region 45 (see FIG. 15). The cavity region 45 may be of any suitable size, geometrical configuration and depth. The cavity region 45 includes cavity recesses 49 for capturing a spring pin assembly 37 (see FIGS. 2, 22, and 23). A tube (omitted from the Figures), communicating with one of the inlet holes 20, is disposed through a subcarrier aperture 39A to provide a means of applying pressure/vacuum pressure to a bladder member 70. A subcarrier aperture 39B, further communicating with another inlet hole 20 via a tube, provides a means of actuating a lift plate 124, as will be described below. The subcarrier 40 of the present invention may further include an annular groove 47, the purpose of which will also be described later in this application (see FIG. 16). The subcarrier 40 may be manufactured from any suitable material, including stainless steel, aluminum, etc.

Figure 17:
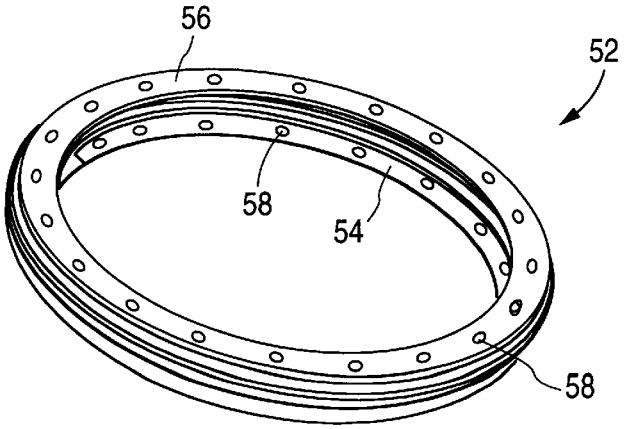
FIG. 17 is a perspective view of the bellows for the polishing head of the present invention having upper and lower edges which register with the second and first lips, respectively.

A bellows 52, as illustrated in FIG. 17, biasedly couples the subcarrier 40 to the driving plate 12 such that the ball sections 28 of the tooling balls 24 are received in the receiving slots 50. The bellows 52 has a lower edge 54 for respectively mating with the first lip 30, and an upper edge 56 for respectively mating with the second lip 44. The bellows 52 additionally has upper and lower bellows recesses 58 disposed on the lower and upper edges 54 and 56. The upper bellows recesses 58 register with the carrier recesses 46 such that the upper edge 56 can be engaged between the second clamp member 48 and the second lip 44 with the screws 36B. Similarly, the lower bellows recesses 58 are aligned with the plate recesses 34 such that the lower edge 54 can be engaged between the first clamp member 38 and the first lip 30 with the screws 36A. A space portion 60 is located between the driving plate 12 and the subcarrier 40. The bellows 52 is manufactured from any suitable material including plastics, polymers, etc., such as ethylene-propylene diene monomer (EPDM), that is capable of flexing and bending. As a result, the subcarrier 40 is capable of actuating in an outwardly direction or away from the driving plate 12, as indicated by arrows 2 of FIG. 26, when a pressure P is applied to the space portion 60 through one of the inlet holes 20. Moreover, the subcarrier 40 is capable of actuating in an inwardly direction or towards the driving plate 12, as indicated by arrows 4 of FIG. 27, when a vacuum pressure VP is applied to the space portion 60 through the inlet hole 20. The motion of the subcarrier 40 in the outwardly direction 2 is limited by a length L of expansion of the bellows 52, whereas the motion in the inwardly direction 4 is limited by the contact of the knobs 23 against the back side 41 of the subcarrier 40.

The polishing head 10 additionally comprises a retaining ring 64 which is engaged to the subcarrier 40. The retaining ring 64 includes an upper ring 66 coupled to a lower ring 68, both having a cylindrical shape of equal inner and outer diameters. The upper ring 66 may be manufactured from any suitable material, including plastics, polymers, etc., such as polyphenylene sulfide (PPS). The lower ring 68 may be manufactured from any suitable material including stainless steel, aluminum, etc. Retaining ring 64 is further described in the co-pending U.S. patent application entitled "Retaining Ring for Wafer Polishing,"Ser. No., attorney docket No. M-5728 US, filed herewith and incorporated herein by reference.

The bladder member 70 is encircled by the retaining ring 64 such that a rim portion 72 of the bladder member 70 is engaged between the lower ring 68 and the subcarrier 40. A shim 69, acting as a sealant, may be provided between the rim portion 72 and the lower ring 68 (see FIG. 4). A side-wall 74 of the bladder member 70, extending from the rim portion 72, is generally communicating with an inside surface 65 of the upper 66 and lower 68 rings of the retaining ring 64. A base 76 extends from the side-wall 74 such that the base 76 is generally positioned slightly lower than a top surface 67 of the upper ring 66 (see FIG. 13). As a result, a pocket 80 is formed by the inner perimeter of the upper ring 66 and the base 76 for containing a substrate 82 (see FIGS. 5 and 9). In one implementation of the bladder member 70, as illustrated by FIGS. 2–5, the side-wall 74 has an indented portion 78 protruding away from retaining ring 64 for allowing the side-wall 74 to complyingly support the base 76. In another implementation of the bladder member 70, as illustrated by FIGS. 6–9, the side-wall 74 extends into a rolling wall 79 which is capable of rolling upwardly and downwardly as indicated by arrows 3. The rolling wall 79 is disposed in the annular groove 47 of the subcarrier 40. The rolling wall 79 also allows the side-wall 74 to complyingly support the base 76. In addition to the substrate 82, the upper ring 66 is also polished during the chemical mechanical polishing process. As a result, a thickness T of the upper ring 66 is reduced during the polishing process. The indented portion 78, the rolling wall 79, or any other combination or variation thereof, allows the polishing head 10 to maintain the pocket 80, despite the reduction in the thickness T of the upper ring 66, by complyingly lowering the base 76 with respect to the top surface 67 of the upper ring 66.

Figure 25A:
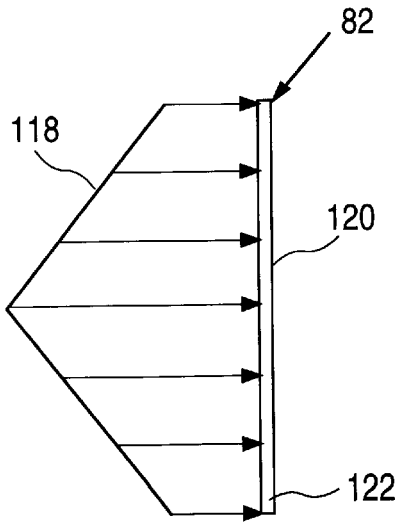
FIGS. 25A–B are examples of pressure profiles on a substrate that can be achieved by employing the base of FIGS. 24I and 24J, respectively.
Figure 25B:
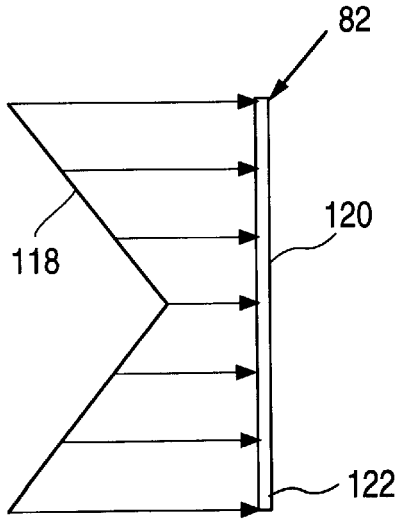

Referring now to FIGS. 24A–24J, there is seen cross sectional views of different implementations of the base 76, which have been exaggerated for illustrative purposes. The base 76 may be geometrically defined by (1) a non-planar top portion 90, having a generally convex shape, opposed by a planar or flat bottom portion 92; (2) a generally non-planar top portion 94, having a flat region 95 extending into inwardly tapered edges 96, opposed by the planar bottom portion 92; (3) a non-planar top portion 98, having a generally concave shape, opposed by the planar bottom portion 92; (4) a generally non-planar top portion 99, having a flat region 95 extending into outwardly tapered edges 100, opposed by the planar bottom portion 92; (5) a planar top portion 102 opposed by a non-planar bottom portion 104 having a generally convex shape; (6) the planar top portion 102 opposed by a non-planar bottom portion 106 having a generally concave shape; (7) a generally non-planar bottom portion 108, defined by the flat region 95 extending into inwardly tapered edges 96, opposed by the planar top portion 102; (8) a generally non-planar bottom portion 109, defined by the flat region 95 extending into outwardly tapered edges 100, opposed by the planar top portion 102; (9) the planar top portion 102 and an outwardly projected, conically shaped, non-planar bottom portion 114; and (10) the planar top portion 102 and an inwardly projected, conically shaped, non-planar bottom portion 116. It is understood that other variations of base 76 may be implemented with the bladder member 70 of the present invention. For example, the base 76 may be defined by a planar top portion and a planar bottom portion or a generally non-planar top portion and a generally non-planar bottom portion. It is further understood that other shapes and geometrical designs may be implemented with the base 76 of the present invention. The non-planar top portions 90, 94, 98, 99 and/or the non-planar bottom portions 104, 106, 108, 109, 114, 116 produce a variation in thickness across the boundary of the base 76. The variation in thickness of the base 76 causes the amount of pressure that is being applied to the substrate 82 to vary across the surface boundary of the substrate 82. For example, a pressure profile 118 for the base 76 having the planar top portion 102 and the outwardly projected, conically shaped, non-planar bottom portion 114 is illustrated by FIG. 25A. The pressure profile 118 decreases from an inner circumferential region 120 to an outer circumference 122 of the substrate 82. In contrast, the pressure profile 118 of the base 76, having the planar top portion 102 and the inwardly projected, conically shaped, non-planar bottom portion 116, increases from the inner circumferential region 120 to the outer circumference 122 of the substrate 82, as illustrated by FIG. 25B. The amount of pressure applied to the substrate 82 is linearly proportional to the polishing or removal rate of material during the chemical mechanical polishing process.

Figure 18:
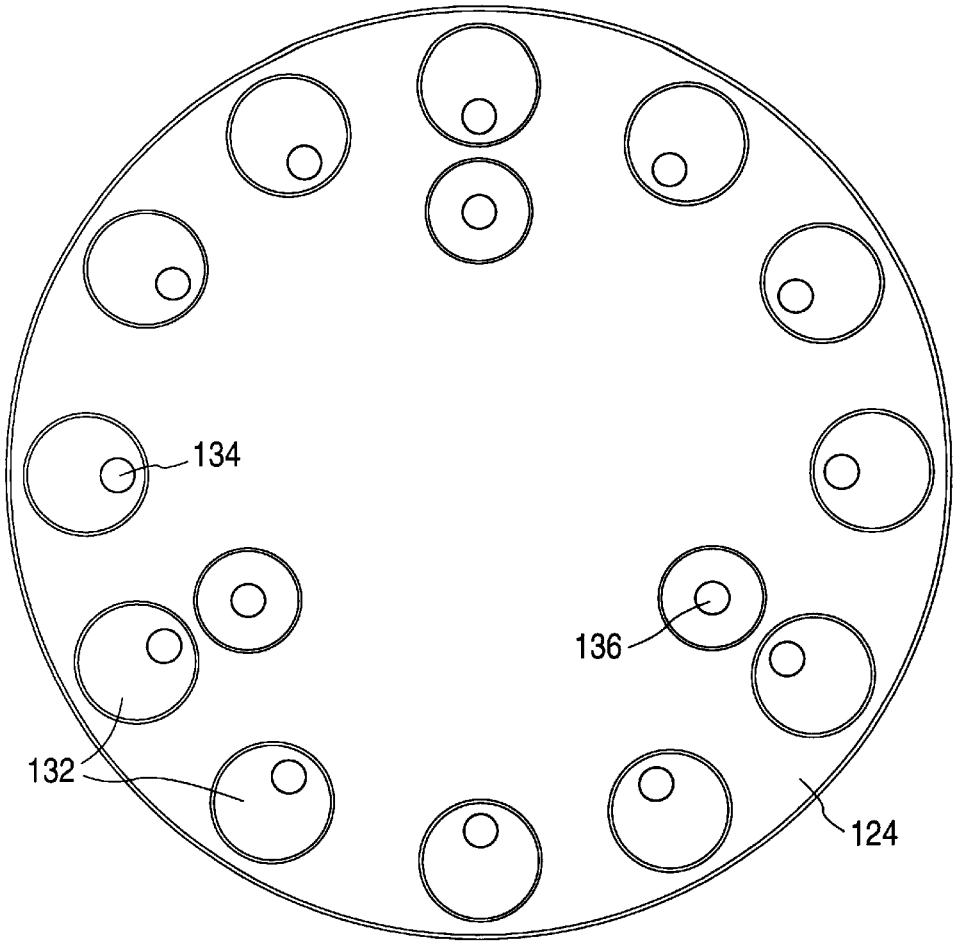
FIG. 18 is a top plan view of the lift plate.

The polishing head 10 may further include a lift plate 124 disposed on the front side 43 of the subcarrier 40, as illustrated by FIG. 18. The lift plate 124 comprises a structure generally defining a backside 126 having a flange portion 128 protruding therefrom. The flange portion 128 registers and slidably engages to the cavity region 45 of the subcarrier 40 (see FIGS. 19, 20, 22 and 23). The lift plate further includes a front side 130 having a plurality of dimples 132 indented therein and bores 134 disposed in the dimples 132. As mentioned above, a tube (omitted from the Figures), connected to one of the inlet holes 20, is disposed through the subcarrier aperture 39A and communicates with the bores 134. The bores 134 provide a means of applying pressure/vacuum pressure to the bladder member 70. The dimples 132 allow the bladder member 70 to releasably grasp the substrate 82 when a vacuum pressure is applied through the bores 134, the details of which will be thoroughly described later in the application. Further structure of the lift plate 124 includes slots 136 which register with cavity recesses 49 for capturing the spring pin assembly 37. The spring pin assembly 37 biasedly couples the lift plate 124 to the subcarrier 40.

Figure 21:
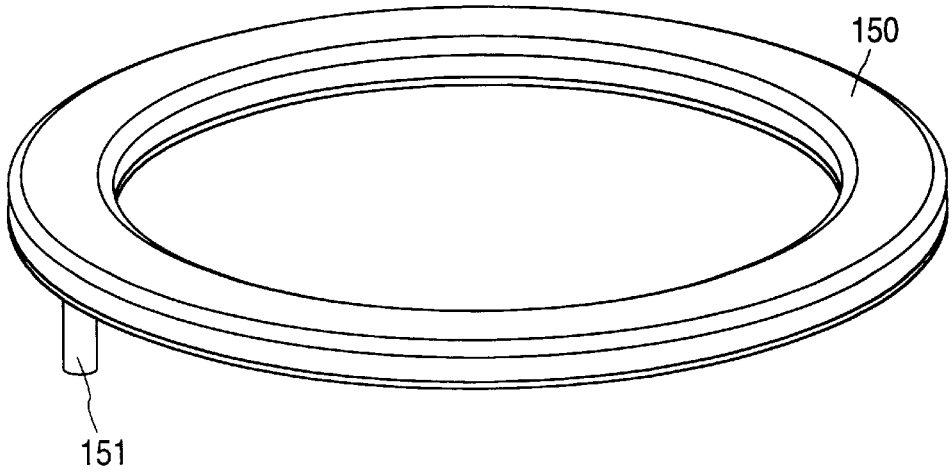
FIG. 21 is a perspective view of the actuator disposed between the lift plate and the subcarrier.
Figure 19:
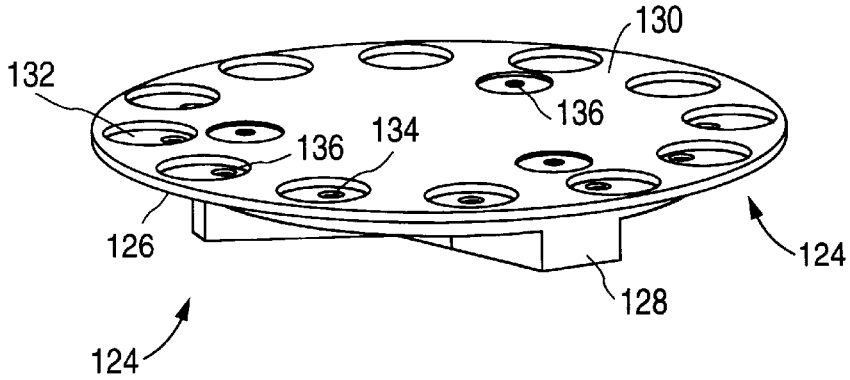
FIG. 19 is a perspective view of the lift plate, clearly illustrating a back side having a flange portion for slidably registering with the cavity region of the subcarrier, a front side having a plurality of apertures which communicated with one of the inlet holes, dimples formed around the apertures, and slots for receiving the spring pin assemblies.
Figure 20:
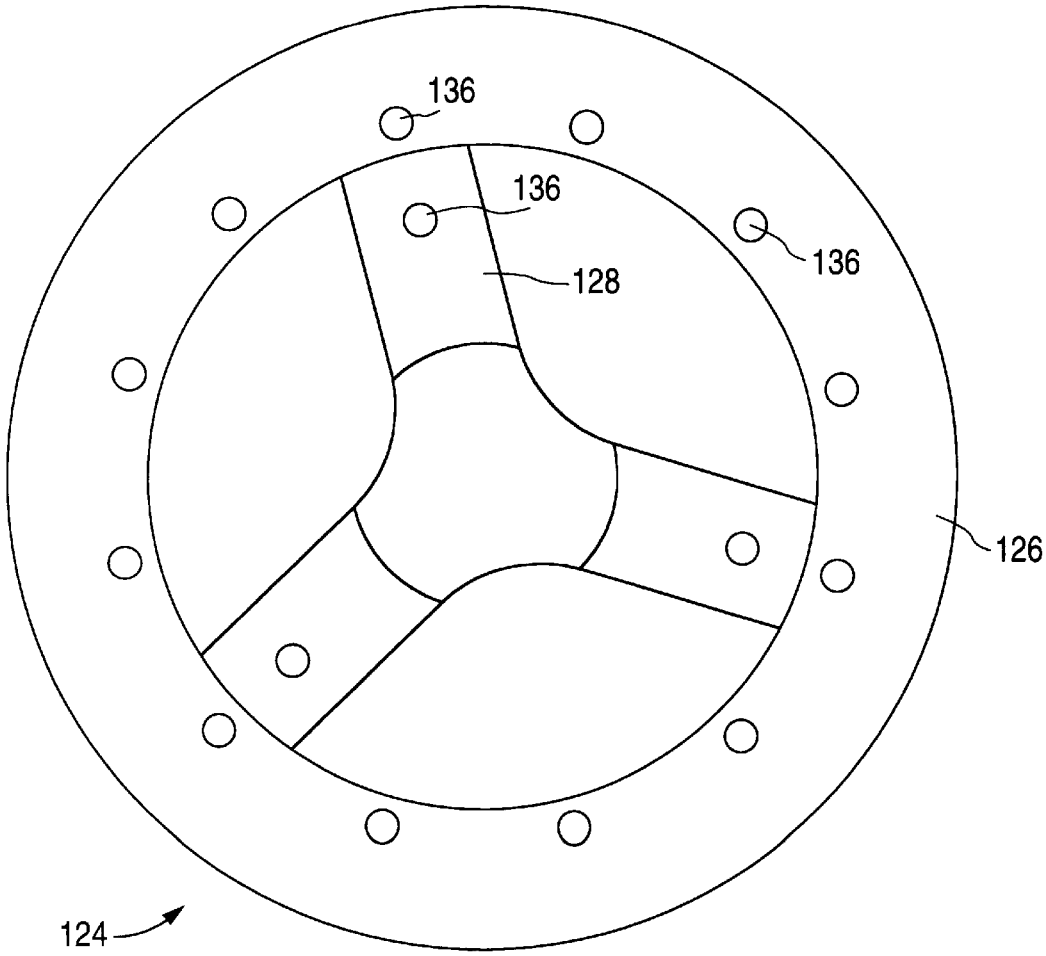
FIG. 20 is a bottom plan of the lift plate clearly illustrating the flange portion protruding from the back side, the apertures, and the slots.
Figure 22:
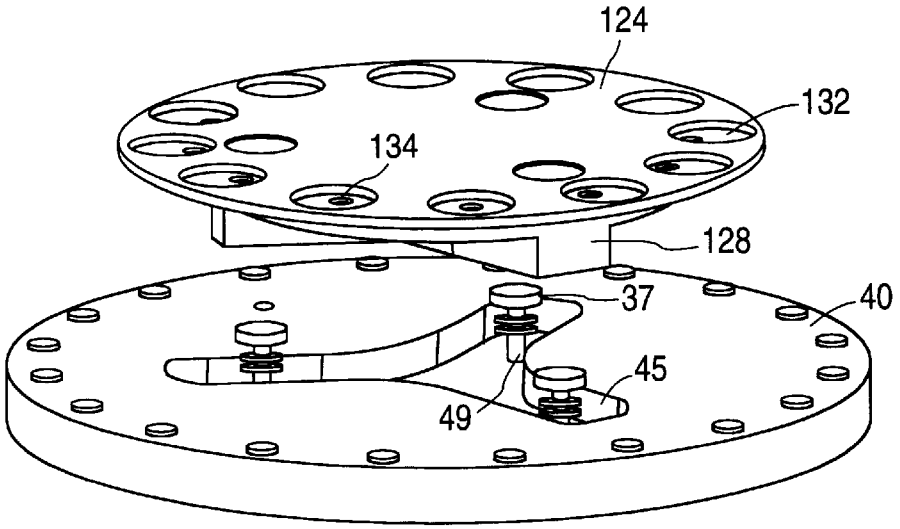
FIG. 22 is a perspective view of the subcarrier disengaged from the lift plate, clearly illustrating the cavity region aligned to register with the flange portion such that the spring pin assemblies biasedly couple the subcarrier to the lift plate.
Figure 23:
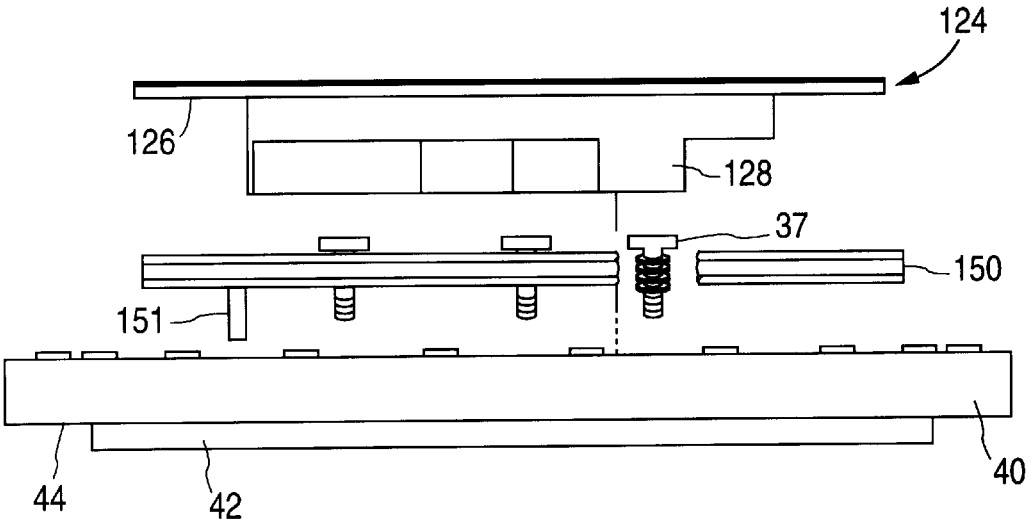
FIG. 23 is an exploded side elevational view of the subcarrier, the lift plate, the actuator, and the spring pin assembly.
Figure 24A:
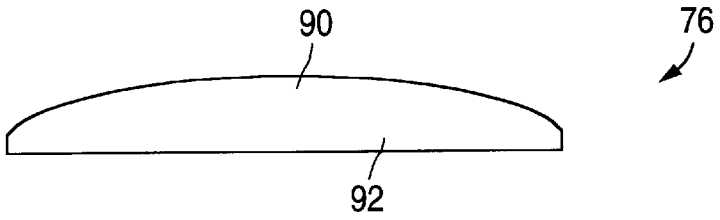
FIGS. 24A–D are exaggerated side cross sectional views of different implementations of the base for the bladder member of the present invention, illustrating a generally non-planar top portion and a planar bottom portion opposing the generally non-planar top portion.
Figure 24B:
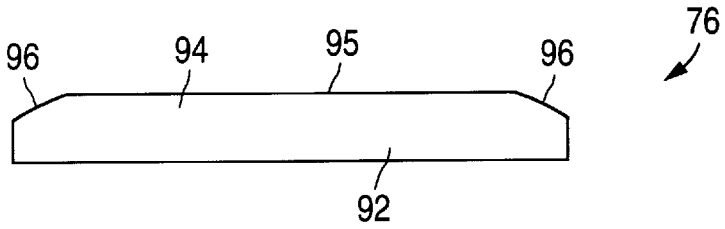
Figure 24C:
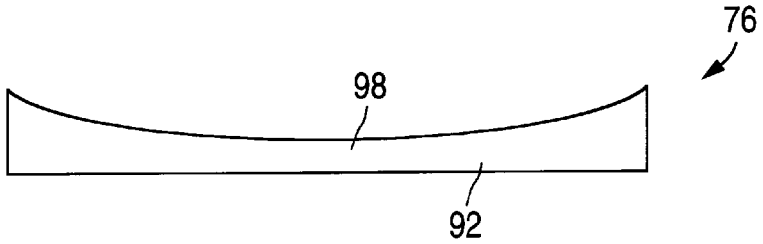
Figure 24D:
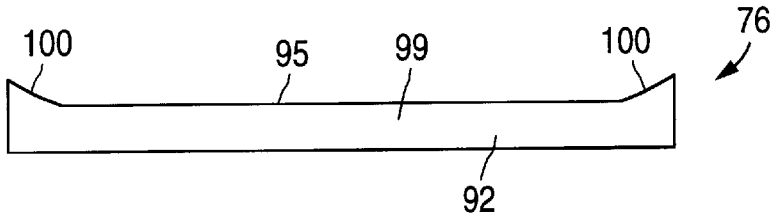
Figure 24E:
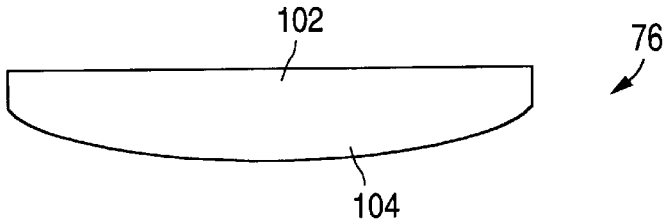
FIGS. 24E–J are exaggerated side cross sectional views of other implementations of the base for the bladder member of the present invention, illustrating a planar top portion and a generally non-planar bottom portion opposing the planar top portion.
Figure 24F:
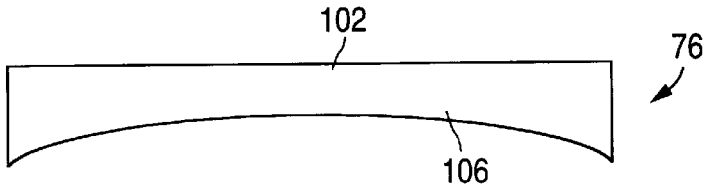
Figure 24G:
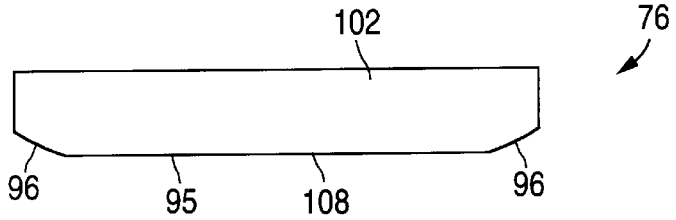
Figure 24H:
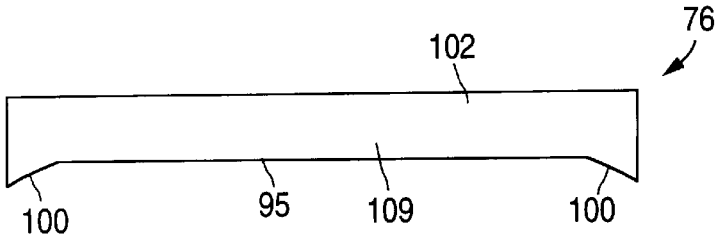
Figure 24I:
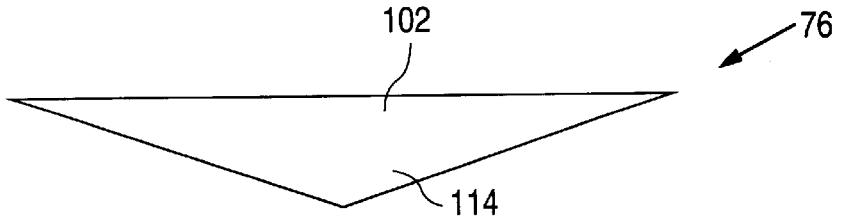
Figure 24J:
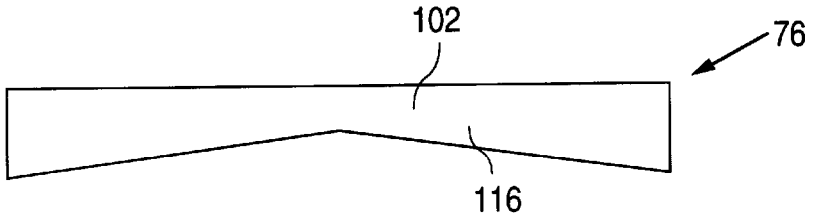

An actuator 150, as illustrate in FIGS. 21 and 23, is positioned on the front side 43 of the subcarrier 40 and communicates with the backside 126 of the lift plate 124. The actuator 150 encircles the flange portion 128 of the lift plate 124. The actuator includes an actuator shaft 151, disposed on a backside thereof, for slidably mating with the subcarrier aperture 39B (see FIG. 16). As discussed above, the subcarrier aperture 39B communicates with one of the inlet holes 20 via a tube (omitted from the figures) such that the application of a pressure through the subcarrier aperture 39B causes the actuator 150 to raise or actuate the lift plate 124 in an outwardly direction, as illustrated by arrow 5 of FIG. 28. When the pressure through aperture 39B is terminated, the spring pin assembly 37 actuates the lift plate 124 in an inwardly direction, as illustrated by arrow 7 of FIGS. 30 and 31.

The spring pin assembly 37, moreover, provides means of guiding the outwardly 5 and inwardly 7 movement of the lift plate 124. The spring pin assembly 37 also limits the distance of actuation for the lift plate 124 in the outwardly direction 5. The spring pin assembly 37, in effect, acts as a stop for the outwardly 5 actuation of the lift plate 124.

Figure 28:
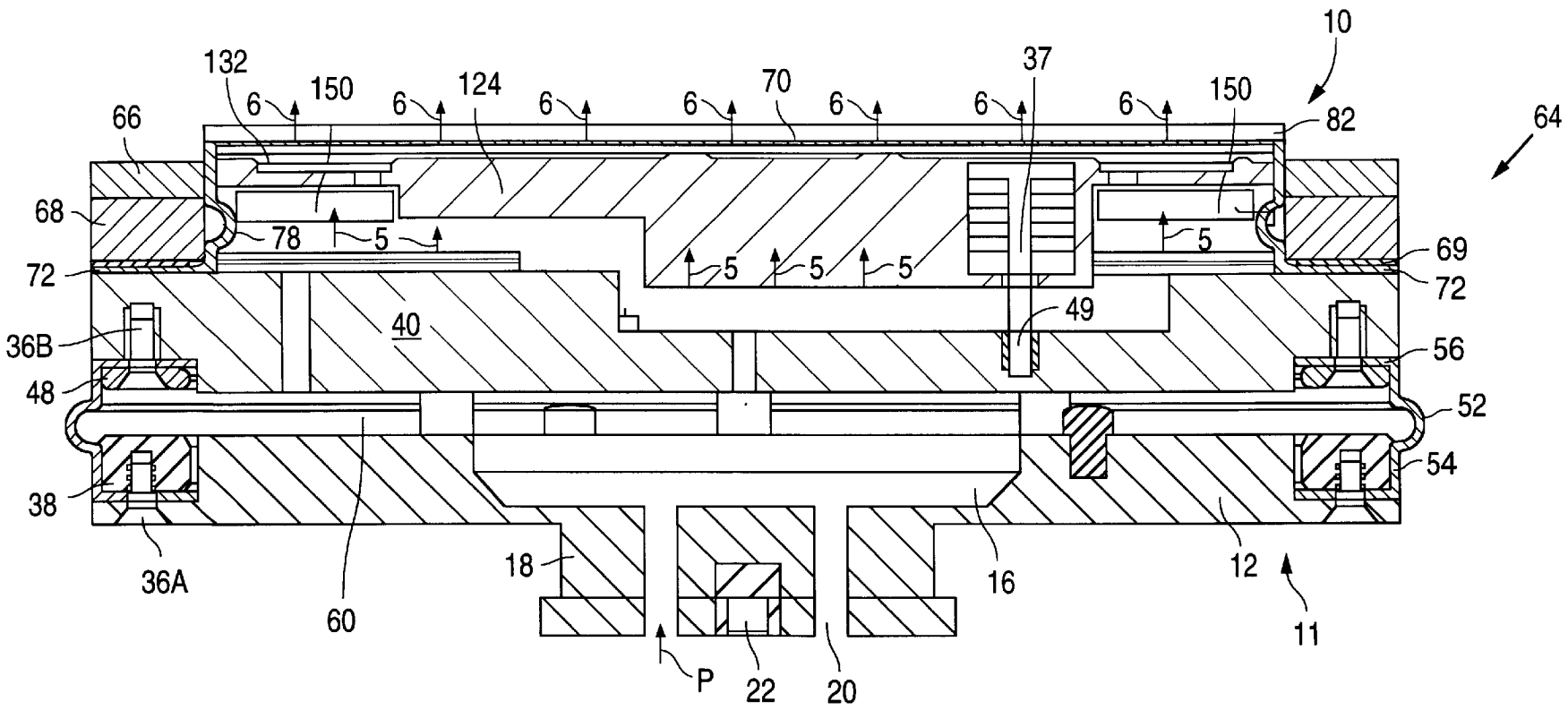
FIG. 28 demonstrates the lift plate of the present invention actuating in an outwardly direction by applying pressure through one of the inlet holes to the actuator; the lift plate compresses the bladder member in an outwardly direction.
Figure 29:
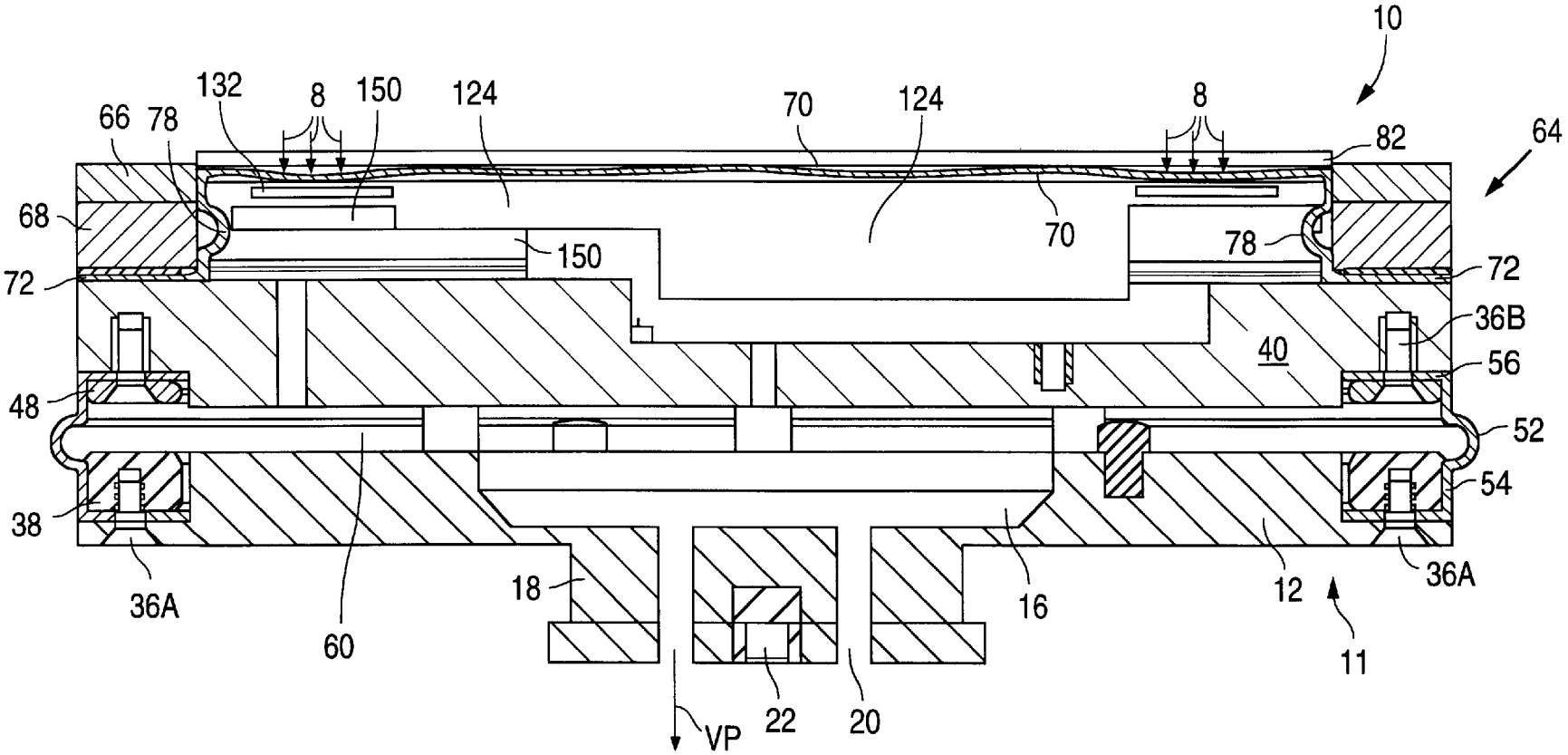
FIG. 29 demonstrates the bladder member of the present invention being withdrawn in an inwardly direction when a vacuum pressure is applied through the apertures of the lift plate such that the dimples allow the bladder member to releasably grasp a substrate by creating a vacuum between the bladder member and the substrate.
Figure 32A:
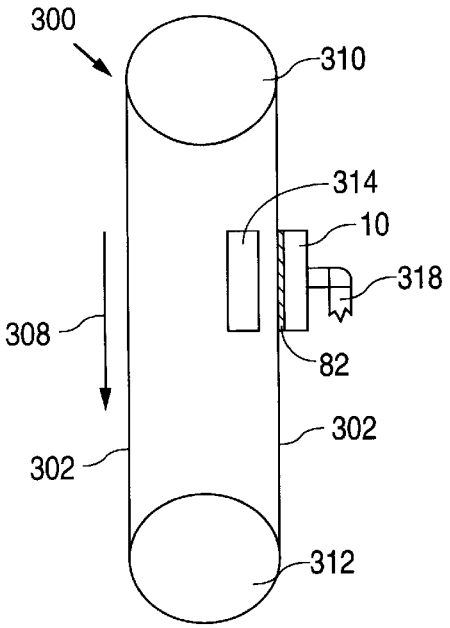
FIG. 32A is a schematic side elevational view of a linear chemical mechanical polishing apparatus for polishing a semiconductor wafer in which a polishing belt is driven about a pair of pulleys, a semiconductor wafer is positioned on the polishing belt by a polishing head, and a back support is opposing the polishing head; the embodiments of the present invention can be employed as the polishing head.
Figure 32B:
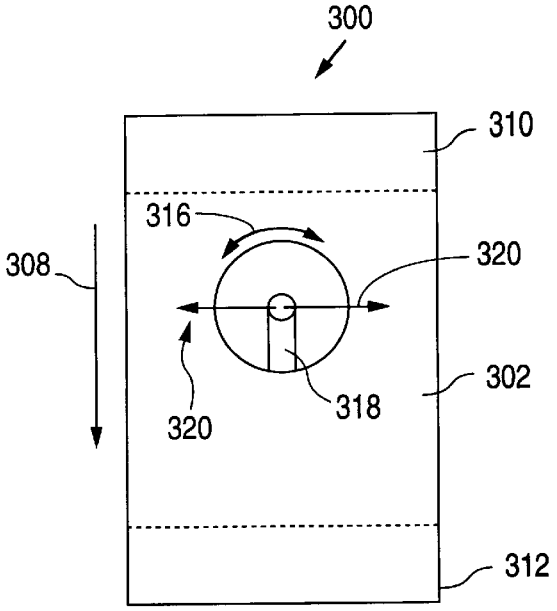
FIG. 32B is a schematic front elevational view of the linear chemical mechanical polishing apparatus of FIG. 32A.
Figure 33A:
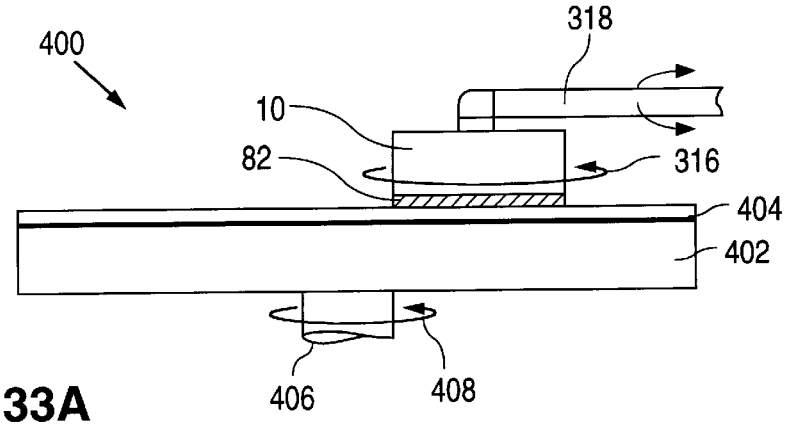
FIG. 33A is a schematic side elevational view of a planar chemical mechanical polishing apparatus for polishing a semiconductor wafer in which a polishing platen supporting a polishing pad is rotated about a shaft and a semiconductor wafer is positioned on the polishing pad by a polishing head; the embodiments of the present invention can be employed as the polishing head.
Figure 33B:
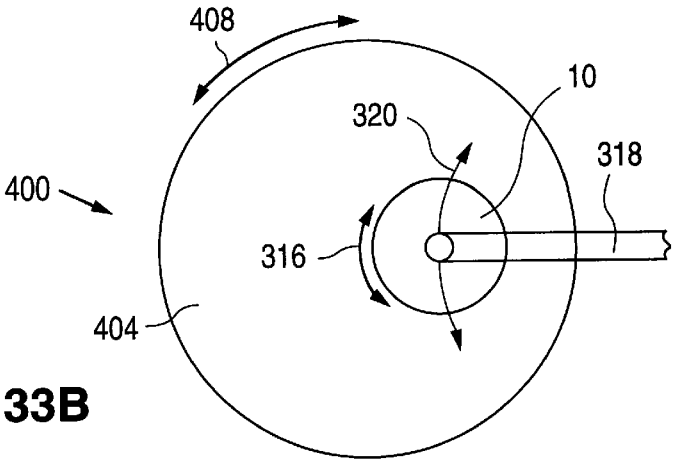
FIG. 33B is a schematic top plan view of the planar chemical mechanical polishing apparatus of FIG. 33A.

To operate the polishing head 10 using the linear chemical mechanical polishing device 300 of FIGS. 32A and 32B, by way of example, the polishing head 10 is initially located at a "load position," as is well known in the art. The lift plate 124 is actuated in the outwardly direction 5, as illustrated in FIG. 28, by applying pressure to the actuator 150 through the designated inlet hole 20. As mentioned above, the spring pin assembly 37 limits the outwardly actuation 5 of the lift plate 124 by a preselected distance. The actuation of the lift plate 124 in the outwardly direction 5 compresses the bladder member 70 in an outwardly direction 6, as illustrated in FIG. 28. The substrate 82 is positioned on the base 76 as is well known in the art. A vacuum pressure VP is applied through the designated inlet hole 20 and bores 134. A selected portion 71 of bladder member 70 is withdrawn in an inwardly direction, as illustrated by arrows 8 of FIG. 29, into the dimples 132 so as to create a suction or a vacuum between the selected portion 71 of the bladder member 70 and the substrate 82. As a result the bladder member 70 releasably grasps the substrate 82.

Figure 26:
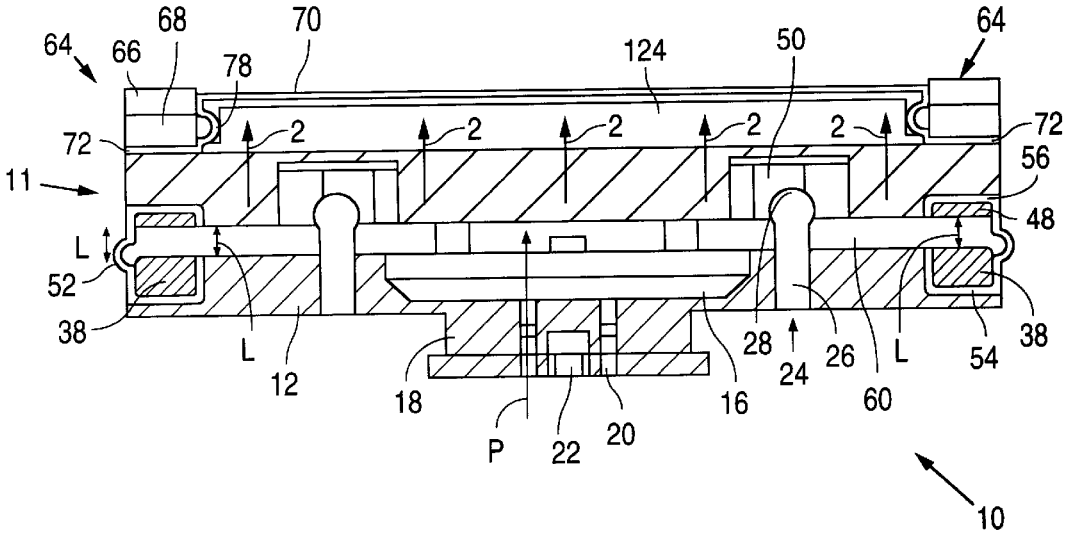
FIG. 26 demonstrates the subcarrier of the present invention actuating in an outwardly direction by applying pressure through an inlet hole.
Figure 27:
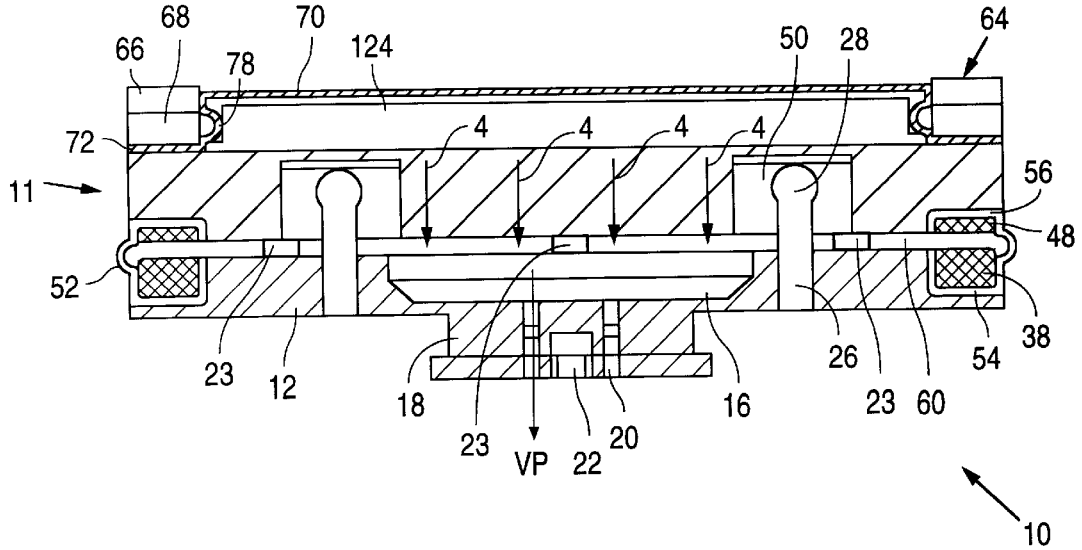
FIG. 27 demonstrates the subcarrier of the present invention actuating in an inwardly direction by the applying vacuum pressure through the inlet hole.
Figure 30:
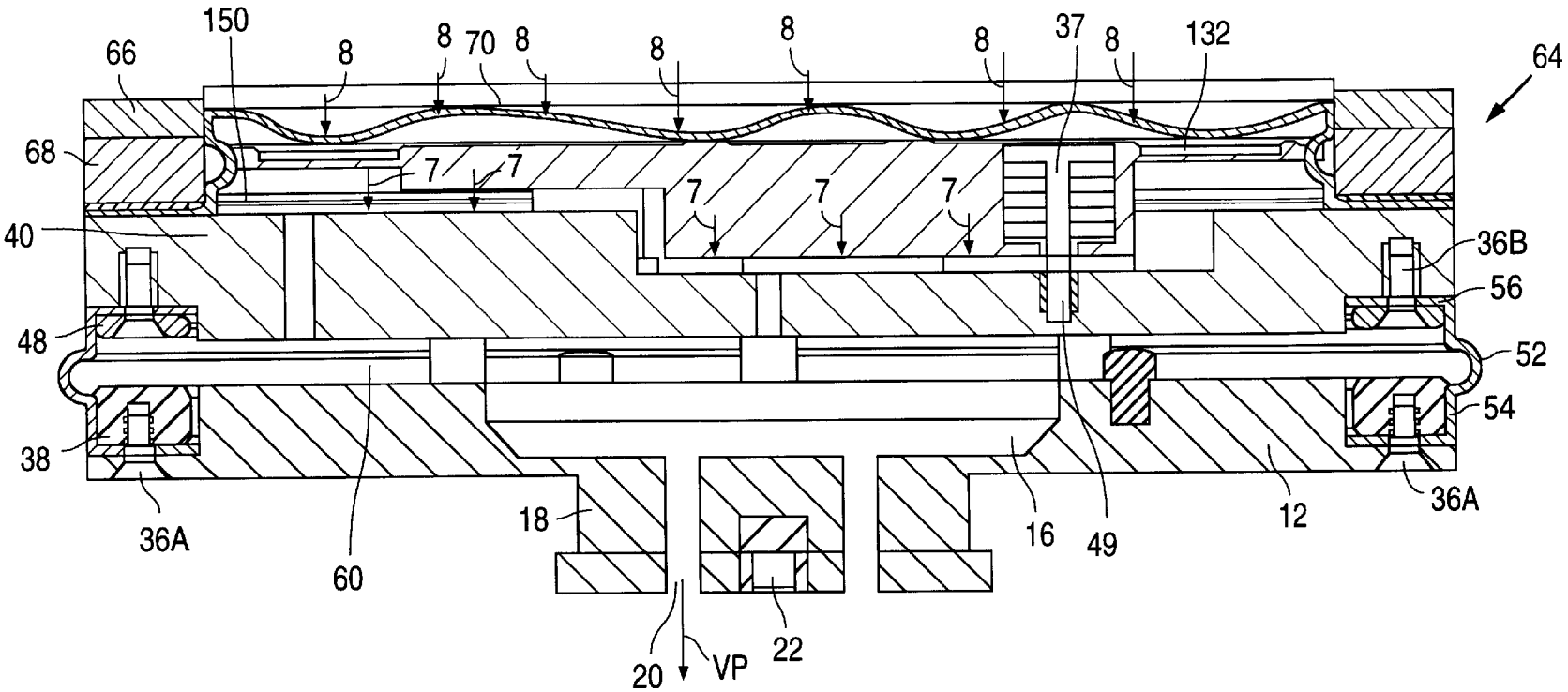
FIG. 30 demonstrates the lift plate of the present invention being actuated in an inwardly direction while maintaining the vacuum between the bladder member and the substrate.
Figure 31:
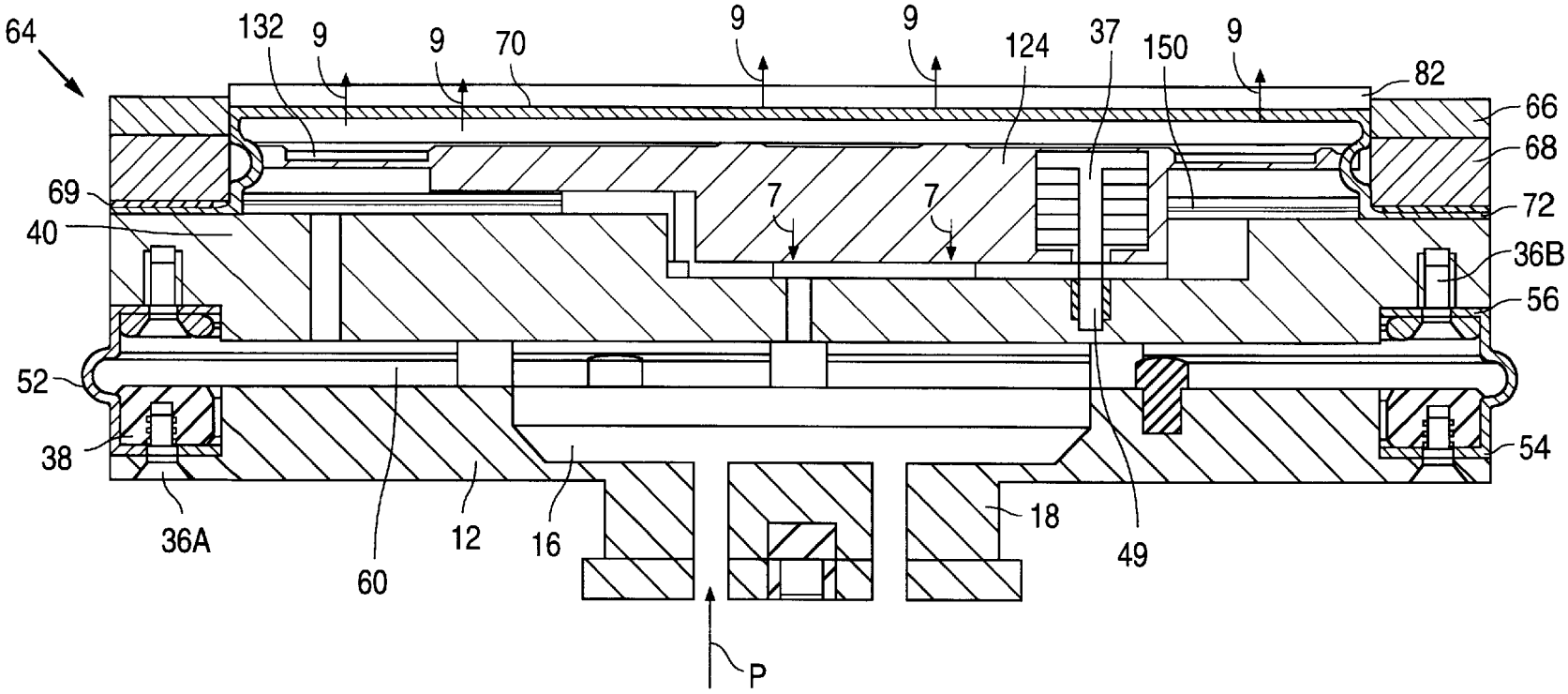
FIG. 31 demonstrates the bladder member for the polishing head of the present invention expanding in an outwardly direction when a pressure is applied through the apertures of the lift plate.

Referring to FIG. 30, the lift plate 124 is actuated in the inwardly direction 7 while maintaining the vacuum pressure VP through the bores 134. The lowering of the lift plate 124 allows the selected portions 71 of the bladder member 70 to further withdraw in the inwardly direction 8 while maintaining the vacuum between the base 76 and the substrate 82. The polishing head 10 can now be positioned proximal to a polishing belt 302 such that the retaining ring 64 does not contact the polishing pad (omitted from the Figures) of the polishing belt 302. The subcarrier 40 is actuated in the outwardly direction 2, as illustrated by FIG. 26, such that the retaining ring 64 abuts to the polishing pad. After the retaining ring 64 is compressed against the polishing pad, the bladder member 70 is expanded in an outwardly direction 9, as illustrated in FIG. 31, by terminating the application of the vacuum pressure VP through the bores 134 and by applying pressure P to the bladder member 70 through the designated inlet hole 20. The application of pressure P causes the bladder member 70 to apply pressure and compress the substrate 82 against the polishing pad at predetermined locations. The geometrical shape of the base 76 employed, as discussed before and as illustrated in FIGS. 24A–24J, affects the pressure profile 118 on the substrate 82.

To polish the substrate 82, the polishing belt 302 is driven in a first direction, as indicated by arrow 308, while the polishing head 10 is oscillated in a second direction, as indicated by arrow 320. The polishing head 10 may also rotate clockwise or counterclockwise, as indicated by arrow 316. During the polishing process, a slurry is applied to the polishing pad. The slurry, used as a fine hydrolyzing abrasive, may be a slightly alkaline colloidal solution. One example of the such slurry includes fine silicone dioxide particles (e.g., average diameter of 70 nm), suspended in deionized water having an adjusted pH of approximately 11. The alkalinity can be provided by potassium hydroxide (KOH) and ammonium hydroxide ($NH_3OH$).

After the polishing process is completed, the application of pressure P to expand the bladder member 70 is terminated. The lift plate 124 is actuated in the outwardly direction 5. The vacuum pressure VP is applied through the bores 134 so that the dimples 132 withdraw the selected portions 71 of the bladder member 70 in the inwardly direction 8. The actuation of the lift plate 124 in the inwardly direction 7, while maintaining the vacuum pressure VP further withdraws the selected portions 71 of the bladder member 70 in the inwardly direction 8 so as to maintain the vacuum between the substrate 82 and the bladder member 70. The subcarrier 40 is actuated in the inwardly direction 4 causing the retaining ring 64 to disengage from the polishing pad. The polishing head 10 is placed at the "load position, and the application of vacuum pressure VP to the bladder member 70 is terminated. The lift plate 124 is actuated in the outwardly direction 5 to compress the bladder member 70 in the outwardly direction 6 (see FIG. 28). The polished substrate 82 is removed.

Thus, while the present invention has been described herein with reference to particular embodiments thereof, a latitude of modifications, various changes and substitutions are intended in the foregoing disclosure, and it will be appreciated that in some instances some features of the invention will be employed without a corresponding use of the other features without departing from the scope of the invention as set forth.

We claim:

1. A polishing head for a polishing apparatus, comprising:

a) a bladder member for allowing a substrate to be contacted by said bladder member wherein said bladder member is used for retracting inwardly to releasably grasp a substrate for polishing, and further wherein said bladder member expands outwardly to apply pressure to said substrate at predetermined locations and to permit release of said substrate therefrom.

b) a retaining ring encircling said bladder member; and c) a backplate supporting said retaining ring.

2. The polishing head of claim 1, wherein said bladder member comprises a base being geometrically defined by a generally non-planar top portion and a planar bottom portion opposing said generally non-planar top portion.

3. The polishing head of claim 1, wherein said bladder member comprises a base being geometrically defined by a generally non-planar top portion and a generally non-planar bottom portion opposing said generally non-planar top portion.

4. The polishing head of claim 1, wherein said bladder member comprises a base being geometrically defined by a planar top portion and a generally non-planar bottom portion opposing said planar top portion.

5. The polishing head of claim 1, wherein said ladder member comprises a base being geometrically defined by a planar top portion and a planar bottom portion opposing said planar top portion.

6. The polishing head of claim 1, wherein said bladder member comprises a base for supporting said substrate and a side-wall extending from said base.

7. The polishing head of claim 6, wherein said side-wall comprises an indented portion formed therein for allowing said side-wall to complyingly support said base.

8. The polishing head of claim 6, wherein said side-wall comprises a rolling wall extending therefrom for allowing said side-wall to complyingly support said base.

9. The polishing head of claim 1, wherein said retaining ring comprises an upper ring made from a polymeric compound.

10. The polishing head of claim 9, wherein said retaining ring additionally comprises a lower ring supporting said upper ring, said lower ring is made from a metallic compound.

11. The polishing head of claim 1, wherein said back plate comprises a driving plate and a subcarrier biasedly coupled to said driving plate.

12. The polishing head of claim 11, wherein said driving plate comprises a structure generally defining a disc member, an inner annular void formed in said disc member, a cap member surrounding said inner annular void and disposed on a backside of said disc member, a plurality of tooling balls engaged on a front side of said disc member, and a plurality of inlet holes formed in said cap member.

13. The polishing head of claim 12, wherein a backside of said subcarrier comprises a plurality of receiving slots for receiving said tooling balls and a front side of said subcarrier comprises a cavity region.

14. The polishing head of claim 13, additionally comprising a lift plate disposed between said subcarrier and said bladder member, wherein said lift plate comprises a structure generally defining a backside having a flange portion for slidably engaging with said cavity region of said subcarrier, a front side having apertures communicating with a first of said inlet holes of said cap member, and dimples formed around said apertures for allowing said bladder member to releasably grasp a substrate when a vacuum pressure is applied through said first of said inlet holes.

15. A polishing head for a polishing apparatus, comprising:

a) a bladder member configured to receive a substrate;

b) a retaining ring encircling said bladder member, and c) a backplate supporting said retaining ring wherein said backplate comprises a driving plate, a subcarrier biasedly coupled to said driving plate, and a bellows for biasedly coupling said subcarrier to said driving plate.

16. The polishing head of claim 15, additionally comprising a lift plate disposed between said subcarrier and said bladder member.

17. The polishing head of claim 16, additionally comprising a spring pin assembly coupling said lift plate to said subcarrier.

18. The polishing head of claim 16, additionally comprising an actuator disposed between said subcarrier and said lift plate for actuating said lift plate.

19. A polishing head for a chemical mechanical polishing apparatus, comprising:

a) a bladder means for receiving a substrate and applying pressure to said substrate at predetermined locations;

b) a retaining means encircling said bladder means for containing a substrate on said bladder means;

c) a backplate means for supporting said retaining means; and d) a means for expanding said bladder means in an outwardly direction such that said bladder means applies pressure to said substrate at said predetermined locations, and means for withdrawing said bladder means in an inwardly direction such that said bladder means releasably rasps said substrate.

20. The polishing head of claim 19, wherein said bladder means comprises a base and a side-wall extending from said base such that said side-wall includes a means for allowing said side-wall to complyingly support said base.

21. The polishing head of claim 19, wherein said backplate means comprises a carrier means supporting said retaining means for compressing said retaining means against a polishing means.

22. The polishing head of claim 21, wherein said backplate means additionally comprises a driving means for biasedly supporting said carrier means, said driving means including a means for biasedly operating said carrier means.

23. The polishing head of claim 19, wherein said backplate means additionally comprises a driving means, a carrier means and a means for biasedly coupling said carrier means to said driving means.

24. The polishing head of claim 19, additionally comprising a means for compressing said bladder means in an outwardly direction.

25. A method for polishing a substrate, comprising:

a) providing a polishing head having a bladder member;

b) positioning a substrate on said bladder member;

c) withdrawing said bladder member in an inwardly direction to create a vacuum between said bladder member and said substrate;

d) positioning said substrate on a polishing pad; and e) polishing said substrate.

26. The method of claim 25, wherein said providing a polishing head (a) additionally comprises providing a retaining ring encircling said bladder member for containing a substrate on said bladder member, a subcarrier supporting said retaining ring for actuating said retaining ring against said polishing pad, a driving plate biasedly coupled to said subcarrier for supporting said subcarrier, and a lift plate supported by said subcarrier and positioned beneath said bladder member.

27. The method of claim 26, additionally comprising, prior to said positioning a substrate (b):

a) placing said polishing head in a load position; and b) actuating said lift plate in an outwardly direction to compress said bladder member in an outwardly direction.

28. The method of claim 27, additionally comprising, subsequent to said withdrawing said bladder member (c), actuating said lift plate in an inwardly direction while maintaining said vacuum between said bladder member and said substrate.

29. The method of claim 26, wherein said positioning said substrate on a polishing pad (d) comprises:

a) positioning said polishing head proximal said polishing pad without said retaining ring contacting said polishing pad; and b) actuating said subcarrier in an outwardly direction such that said retaining ring abuts to said polishing pad.

30. The method of claim 25, wherein said positioning said substrate on a polishing pad (d) comprises expanding said bladder member in an outwardly direction such that said bladder member applies pressure to said substrate at predetermined locations.

31. The method of claim 25, wherein said polishing (e) comprises:

a) driving said polishing pad in a first direction;

b) applying a slurry to said polishing pad;

c) oscillating said polishing head, including said substrate in a second direction; and d) rotating said polishing head including said substrate about an axis perpendicular to said polishing pad.

* * * * *

UNITED STATES PATENT AND TRADEMARK OFFICE

CERTIFICATE OF CORRECTION

PATENT NO. : 6,159,083
DATED : December 12, 2000
INVENTOR(S) : Appel et al.

It is certified that error appears in the above-identified patent and that said Letters Patent is hereby corrected as shown below:

Column 11,
Line 34, delete “ladder” and insert -- bladder --.

Signed and Sealed this

Fourth Day of March, 2003

JAMES E. ROGAN
*Director of the United States Patent and Trademark Office*